US008539931B1

(12) United States Patent
Hanna

(10) Patent No.: US 8,539,931 B1
(45) Date of Patent: Sep. 24, 2013

(54) ROTARY INTERNAL COMBUSTION DIESEL ENGINE

(76) Inventor: Yousry Kamel Hanna, Philadelphia, PA (US)

( * ) Notice: Subject to any disclaimer, the term of this patent is extended or adjusted under 35 U.S.C. 154(b) by 617 days.

(21) Appl. No.: 12/802,619

(22) Filed: Jun. 10, 2010

Related U.S. Application Data

(60) Provisional application No. 61/269,756, filed on Jun. 29, 2009.

(51) Int. Cl.
*F02B 53/00* (2006.01)

(52) U.S. Cl.
USPC ..... 123/241; 123/210; 418/61.2; 418/150

(58) Field of Classification Search
USPC ..... 123/241, 210, 211, 218; 418/61.2, 418/150
See application file for complete search history.

(56) References Cited

U.S. PATENT DOCUMENTS

| | | | | |
|---|---|---|---|---|
| 1,340,625 | A * | 5/1920 | Planche | 418/150 |
| 2,455,245 | A | 11/1948 | Louis | |
| 3,266,469 | A | 8/1966 | Sink | |
| 3,285,503 | A | 11/1966 | Charles | |
| 3,288,120 | A | 11/1966 | Heinz | |
| 3,709,199 | A | 1/1973 | Molyneaux | |
| 3,805,746 | A | 4/1974 | Ishii | |
| 3,809,023 | A | 5/1974 | Wells | |
| 3,854,456 | A | 12/1974 | Ishii | |
| 3,881,847 | A | 5/1975 | Chen | |
| 3,893,431 | A | 7/1975 | Gregg | |
| 3,931,809 | A | 1/1976 | Corte | |
| 3,945,346 | A | 3/1976 | Daniels, Jr. | |
| 3,994,266 | A | 11/1976 | Jones | |
| 4,072,132 | A | 2/1978 | Lindros | |
| 4,074,522 | A | 2/1978 | McDowell | |
| 4,133,617 | A * | 1/1979 | Reynaud | 418/150 |
| 4,202,313 | A | 5/1980 | Rosaen | |
| 4,274,374 | A | 6/1981 | Lee | |
| 4,300,874 | A * | 11/1981 | Georgiev | 418/150 |
| 4,331,108 | A | 5/1982 | Collins | |
| 4,434,757 | A | 3/1984 | Walker | |
| 4,974,553 | A | 12/1990 | Murray | |
| 5,036,809 | A | 8/1991 | Goodman | |
| 5,103,775 | A | 4/1992 | Hue | |
| 5,322,425 | A * | 6/1994 | Adiwinata | 418/61.2 |
| 5,399,078 | A * | 3/1995 | Kuramasu | 418/61.2 |
| 6,227,832 | B1 * | 5/2001 | Rechberger | 418/150 |

(Continued)

FOREIGN PATENT DOCUMENTS

JP 60150432 A * 8/1985

*Primary Examiner* — Mary A Davis
(74) *Attorney, Agent, or Firm* — Muskin & Cusick, LLC; Shawn R. Farmer; Jon H. Muskin

(57) ABSTRACT

A rotary internal combustion diesel engine (46) comprising: a posterior plate (78), an intermediate plate (80), and an anterior plate (82); a rotor-housing unit (46) on each side of the intermediate plate (80), each containing a yousroid chamber (48), and a 2-apex rotor (56) containing an aperture (58). The chamber (48) wall contains an intake valve (68), an exhaust valve (70), and a fuel supply device (72); in gasoline embodiments, an ignition device (76) is added; compressed air/gas and hydraulic embodiments, require an input port (74) and an output port (70*a*). A shaft (52) rotatably mounted, extends through the housing, having essentially rectangular segments (54) within the chambers (48). There are seals (not shown) on the rotor apices (60, 62) and on the anterior (82) intermediate (80), and posterior plate (78).

12 Claims, 25 Drawing Sheets

(56) References Cited

U.S. PATENT DOCUMENTS

| | | | | |
|---|---|---|---|---|
| 6,236,897 | B1 * | 5/2001 | Lee et al. | 418/150 |
| 6,250,279 | B1 | 6/2001 | Zack | |
| 6,289,867 | B1 | 9/2001 | Free | |
| 6,401,686 | B1 | 6/2002 | Prueitt | |
| 6,530,357 | B1 | 3/2003 | Yaroshenko | |
| 6,536,383 | B2 | 3/2003 | Santiyanont | |
| 6,722,321 | B2 | 4/2004 | Kim | |
| 6,766,783 | B1 | 7/2004 | Person | |
| 6,883,489 | B2 | 4/2005 | Hochwald | |
| 6,886,528 | B2 | 5/2005 | James | |
| 6,892,692 | B2 | 5/2005 | Barrett | |
| 6,935,300 | B2 | 8/2005 | Gehman | |
| 7,121,235 | B2 | 10/2006 | Schmied | |
| 7,434,563 | B2 | 10/2008 | Kim | |
| 7,500,461 | B2 | 3/2009 | Baier | |
| 2001/0010801 | A1 | 8/2001 | Turner | |
| 2002/0179036 | A1 | 12/2002 | Duncan | |
| 2003/0084657 | A1 | 5/2003 | Duncan | |
| 2003/0106504 | A1 | 6/2003 | Kim | |
| 2003/0116119 | A1 | 6/2003 | Duncan | |
| 2003/0192503 | A1 | 10/2003 | James | |
| 2004/0035385 | A1 | 2/2004 | Thomas | |
| 2004/0074470 | A1 | 4/2004 | Plichta | |
| 2004/0182357 | A1 | 9/2004 | Makler | |
| 2005/0019195 | A1 | 1/2005 | Schnabl | |
| 2005/0051129 | A1 | 3/2005 | Watkins | |
| 2005/0145213 | A1 | 7/2005 | Schapiro | |
| 2005/0175493 | A1 | 8/2005 | Arnold | |
| 2005/0186100 | A1 | 8/2005 | Weatherbee | |
| 2005/0193975 | A1 | 9/2005 | Kim | |
| 2005/0246859 | A1 | 11/2005 | Castronovo | |
| 2006/0150948 | A1 | 7/2006 | Pontiggia | |
| 2006/0174852 | A1 | 8/2006 | Huettlin | |
| 2006/0191499 | A1 | 8/2006 | Huettlin | |
| 2006/0233653 | A1 * | 10/2006 | Trapalis | 418/150 |
| 2006/0288977 | A1 | 12/2006 | Stark | |
| 2007/0084434 | A1 | 4/2007 | Leon | |
| 2007/0089701 | A1 | 4/2007 | Schapiro | |
| 2007/0128063 | A1 * | 6/2007 | Zelezny | 418/61.2 |
| 2007/0209632 | A1 | 9/2007 | Wagner | |
| 2007/0240674 | A1 | 10/2007 | Peitzke | |
| 2008/0011267 | A1 | 1/2008 | Sakita | |
| 2008/0098982 | A1 | 5/2008 | Sakita | |
| 2008/0135012 | A1 | 6/2008 | Shuba | |
| 2008/0190395 | A1 | 8/2008 | Rom | |
| 2008/0202466 | A1 | 8/2008 | Webster | |
| 2008/0219876 | A1 | 9/2008 | Arnold | |
| 2009/0025677 | A1 | 1/2009 | Waal | |
| 2009/0084099 | A1 | 4/2009 | Parvov | |
| 2009/0087330 | A1 | 4/2009 | Hunt | |
| 2009/0101103 | A1 | 4/2009 | Shimizu | |
| 2009/0114184 | A1 | 5/2009 | Wang | |
| 2009/0126681 | A1 | 5/2009 | Cobb | |
| 2009/0148323 | A1 | 6/2009 | Scheen | |
| 2009/0185937 | A1 | 7/2009 | Didin | |
| 2009/0255506 | A1 | 10/2009 | Walker | |
| 2010/0006059 | A1 | 1/2010 | Tradler | |
| 2010/0050981 | A1 | 3/2010 | Ivas | |
| 2010/0083933 | A1 | 4/2010 | Varga | |
| 2010/0095667 | A1 | 4/2010 | Yamamoto | |
| 2010/0108034 | A1 | 5/2010 | Arseneau | |
| 2010/0122684 | A1 | 5/2010 | De Oliveira | |

* cited by examiner

ROTARY INTERNAL COMBUSTION DIESEL ENGINE

CROSS-REFERENCED TO RELATED APPLICATION

This application claims the benefit of U.S. provisional patent application Ser. No. 61/269,756 filed Jun. 30, 2009 titled "Rotary Internal Combustion Diesel Engine" by the present inventor.

FEDERALLY SPONSORED RESEARCH

Not Applicable

SEQUENCE LISTING OR PROGRAM

Not Applicable

FIELD OF THE INVENTION

This invention relates to the art of ROTARY MECHANISMS in general, and specifically relates to the art of ROTARY INTERNAL COMBUSTION ENGINES wherein combustible gases are compressed, ignited, and expanded to rotate the engine shaft and to the art of non-combusting rotary pumps and motors; it is furthermore capable of being modified to use numerous types of fuels and gases, for use on all types of rotary-driven tools and machines for industrial, medical, agricultural, commercial, military, and personal use, as well as for use on all types of transportation vehicles, including land, sea, and air transport now known or later developed, and for any other application.

DESCRIPTION OF THE PRIOR ART

Prior art of possible relevance to this invention has not been identified as of this date. The following United States patent documents were examined in search of prior art containing the disclosures presented in this patent application:

| | | |
|---|---|---|
| 2,455,245 | Louis | Nov. 30, 1948 |
| 3,266,469 | Sink | Aug. 16, 1966 |
| 3,285,503 | Charles | Nov. 15, 1966 |
| 3,288,120 | Heinz | Nov. 29, 1966 |
| 3,709,199 | Molyneaux | Jan. 09, 1973 |
| 3,805,746 | Ishii | Apr. 23, 1974 |
| 3,809,023 | Wells | May 07, 1974 |
| 3,854,456 | Ishii | Dec. 17, 1974 |
| 3,881,847 | Chen | May 06, 1975 |
| 3,893,431 | Gregg | Jul. 08, 1975 |
| 3,931,809 | Corte | Jan. 13, 1976 |
| 3,945,346 | Daniels, Jr. | Mar. 23, 1976 |
| 3,994,266 | Jones | Nov. 30, 1976 |
| 4,072,132 | Lindros | Feb. 07, 1978 |
| 4,074,522 | McDowell | Feb. 21, 1978 |
| 4,202,313 | Rosaen | May 13, 1980 |
| 4,274,374 | Lee | Jun. 23, 1981 |
| 4,331,108 | Collins | May 25, 1982 |
| 4,434,757 | Walker | Mar. 06, 1984 |
| 4,974,553 | Murray | Dec. 04, 1990 |
| 5,036,809 | Goodman | Aug. 06, 1991 |
| 5,103,775 | Hue | Apr. 14, 1992 |
| 6,250,279 | Zack | Jun. 26, 2001 |
| 20010010801 | Turner | Aug. 02, 2001 |
| 6,289,867 | Free | Sep. 18, 2001 |
| 6,401,686 | Prueitt | Jun. 11, 2002 |
| 20020179036 | Duncan | Dec. 05, 2002 |
| 6,530,357 | Yaroshenko | Mar. 11, 2003 |
| 6,536,383 | Santiyanont | Mar. 25, 2003 |

-continued

| | | |
|---|---|---|
| 20030084657 | Duncan | May 08, 2003 |
| 20030106504 | Kim | Jun. 12, 2003 |
| 20030116119 | Duncan | Jun. 26, 2003 |
| 20030192503 | James | Oct. 16, 2003 |
| 20040035385 | Thomas | Feb. 26, 2004 |
| 6,722,321 | Kim | Apr. 20, 2004 |
| 20040074470 | Plichta | Apr. 22, 2004 |
| 6,766,783 B1 | Person | Jul. 27, 2004 |
| 20040182357 | Makler | Sep. 23, 2004 |
| 20050019195 | Schnabl | Jan. 27, 2005 |
| 20050051129 | Watkins | Mar. 10, 2005 |
| 6,883,489 | Hochwald | Apr. 26, 2005 |
| 6,886,528 | James | May 03, 2005 |
| 6,892,692 | Barrett | May 17, 2005 |
| 20050145213 | Schapiro | Jul. 07, 2005 |
| 20050175493 | Arnold | Aug. 11, 2005 |
| 20050186100 | Weatherbee | Aug. 25, 2005 |
| 6,935,300 | Gehman | Aug. 30, 2005 |
| 20050193975 | Kim | Sep. 08, 2005 |
| 2005026859 | Castronovo | Nov. 10, 2005 |
| 20060150948 | Pontiggia | Jul. 13, 2006 |
| 20060174852 | Huettlin | Aug. 10, 2006 |
| 20060191499 | Huettlin | Aug. 31, 2006 |
| 7,121,235 | Schmied | Oct. 17, 2006 |
| 20060288977 | Stark | Dec. 28, 2006 |
| 20070084434 | Leon | Apr. 19, 2007 |
| 20070089701 | Schapiro | Apr. 26, 2007 |
| 20070209632 | Wagner | Sep. 13, 2007 |
| 20070240674 | Peitzke | Oct. 18, 2007 |
| 20080011267 | Sakita | Jan. 17, 2008 |
| 20080098982 | Sakita | May 01, 2008 |
| 20080135012 | Shuba | Jun. 12, 2008 |
| 20080190395 | Rom | Aug. 14, 2008 |
| 20080202466 | Webster | Aug. 28, 2008 |
| 20080219876 | Arnold | Sep. 11, 2008 |
| 7,434,563 | Kim | Oct. 14, 2008 |
| 741,626 | Kimes | Dec. 09, 2008 |
| 20090025677 | Waal | Jan. 29, 2009 |
| 7,500,461 | Baier | Mar. 10, 2009 |
| 20090084099 | Parvov | Apr. 02, 2009 |
| 20090087330 | Hunt | Apr. 02, 2009 |
| 20090101103 | Shimizu | Apr. 23, 2009 |
| 20090114184 | Wang | May 07, 2009 |
| 20090126681 | Cobb | May 21, 2009 |
| 20090148323 | Scheen | Jun. 11, 2009 |
| 20090185937 | Didin | Jul. 23, 2009 |
| 20090255506 | Walker | Oct. 15, 2009 |
| 20100006059 | Tradler | Jan. 14, 2010 |
| 20100050981 | Ivas | Apr. 04, 2010 |
| 20100083933 | Varga | Apr. 08, 2010 |
| 20100095667 | Yamamoto | Apr. 22, 2010 |
| 20100108034 | Arseneau | May 06, 2010 |
| 20100122684 | De Oliveira | May 20, 2010 |

The particulars of the present invention have neither been contemplated nor anticipated in the patents that were examined. Several issues have been of interest during the course of searching prior art: First, it is noted that not every design is capable of functioning as a rotary diesel engine. Second, none of the designs examined bears any resemblance to the engine in this application. Third, prior art patents place great emphasis on the shape and function of the design's combustion chamber. It appears that the goal of rotary engine design is to find a chamber and rotor combination that synchronizes perfectly so that these two components, working together, generate an entire range of power output using a minimum number of moving parts. The claims sections of many rotary engine patents specify the shape of chamber and rotor, not merely for descriptive purposes, but to protect a critical feature of an entire engine concept. Previously patented chamber designs include chambers which are circular, spherical, oval, epitrochoidal, annular, triangular, cylindrical, interlaced circular shaped, toroidal, concentric cylinders, and overlapping circles, to mention a few. Rotors have been presented as triangular, cylindrical, elliptical, crescent-shaped, disk shaped, annular, and oval. The foregoing widely diverse rotary engine designs show that there is an ongoing quest for a design that offers all of the advantages of the Wankel, but can also function as a diesel engine, and that furthermore offers breakthrough solutions in terms of chamber/rotor synergy, reliability, functionality, adaptability, and economy. It would appear that some solutions proffered to date tend to be more complex than the original Wankel engine and therefore, while addressing certain long-term shortcomings, tend to introduce new feasibility issues. The quest for a simple, straightforward, and comprehensive design gives rise to the present invention and its various embodiments.

BACKGROUND OF THE INVENTION

Objects of the Invention

It is an object of the present invention to introduce a new rotary engine configuration that dispenses with the need for an epitrochoid combustion chamber and a three-apex rotor. In particular, there is concern about the need for junction lobes on the chamber wall, as well as the need for a triangular piston (Reulleaux triangle). These bumps or junctions in the chamber wall have a place in the Wankel design: in cooperation with the rotor, they separate the chamber into three sub-chambers, make the chamber airtight, allow for the compartmentalization of the various Otto cycle phases. However, from another perspective they are a necessary requirement of a particular formulation and do not represent an optimal design. The lobe junctions in the Wankel design act like speed bumps on a highway—they inhibit forward motion. These lobes interfere with the smooth, continuous operation of the rotor, cause wear and tear on the seals, and generate unnecessary vibration. Thus, it is another object of this invention to create a combustion chamber wall that is free of any protrusions that would in any way interfere with the forward progress of a rotary drive element.

It is a further object of the present invention to produce a rotary engine that is simpler than the Wankel configuration and that utilizes a minimum number of moving parts. It would appear that most of the alternative solutions and/or improvements to the Wankel tend to introduce additional complexities. Indeed, some recently patented rotary engine designs are highly intricate and complex, containing many components and many moving parts.

It is a further object of the present invention to a produce a device capable of operating as a diesel engine, but easily reconfigured to function in other embodiments, including, but not limited to, gasoline engines, steam engines, hydraulic motors, air-pressure motors, gas-pressure motors, fluid and hydraulic pumps, and air pumps.

It is a further object of this invention to provide a combustion engine that operates with the use of a "straight through" or simple shaft rather than an eccentric shaft. This object addresses concern with the use an eccentric shaft and the resulting vibration caused by the spinning rotor turning on an axis offset from the shaft axis. Since the use of an eccentric shaft is a necessary solution to an otherwise intractable problem, namely the interaction of a rotary drive element and its chamber, it is believed that the present invention's new configuration will contribute toward eliminating the source of the problem and thereby eliminate the need for an eccentric shaft. The shaft should have a precisely defined stationary position yet allow the apices of a rotary drive element to remain in continuous contact with the chamber wall, and be both simpler and less costly to manufacture than a conventional rotary eccentric shaft.

It is a further object of this invention is to provide a rotary engine in which the combustion chamber and the rotary drive element fit together perfectly "hand in glove," without the need, for any other adjustments, be they design or mechanical, to compensate for their otherwise inherent inability to mesh perfectly, without resorting to compensating hardware.

It is a further object of this invention to outfit an engine with at least two rotors, each in its own compartment, able to rotate in a clockwise direction and swing freely from side to side in accordance with the shape of the chamber.

It is a further object of this invention to propose an engine amenable to having additional pairs of rotary drive elements added, cascaded on the same plane, operating in tandem with the first pair, and achieving a vastly increased level of continuous power output without resorting to placing the additional pairs of rotary drive elements at a 90° angle to the first pair, but capable of doing so if necessary.

It is a further object of this invention to allow the rotary drive elements and shaft to turn at exactly the same number of revolutions; that is, at the same rotational speed. This in contrast to those engines using the Wankel pattern, in which the drive shaft makes three revolutions for every single revolution of the rotor. As noted by Wang (U.S patent 20090114184), the power output in a traditional rotary engine is limited due to this difference in rotation speed.

It is a further object of this invention to maintain a simplicity of design and construction, incorporating features common to conventional rotary engines, such as: a housing, a shaft, rotary drive element(s), spring-loaded seals, intake and exhaust ports/valves with activators, a fuel supply system, and in a gasoline version, an ignition device. However, it is desired to eliminate many of the components important to other designs, such as: baffles, paddles, vanes or other appendages attached to the rotor; trough-like pockets or recesses on the rotor faces; a complex/multi-segmented shaft, a gear train (whether intermeshing, epicyclical, or planetary gear system), gear teeth on the rotors, and rotor journals or lobes.

The aforementioned objectives result in the formulation of a rotary engine design that constitutes the basis of the present invention.

Advantages of the Invention

The following are some of the advantages of the present invention:

The unique shape of the working chamber permits the use of a two-apex rotary drive element rather than a three-apex rotor that is used in engine designs currently in production. The use of a two-apex rotary drive element rather than a three-apex rotor translates into less friction, heat, and wear on the chamber wall.

The engine housing is simpler to manufacture than a complex epitrochoid rotary engine chamber.

The engine chamber wall is one continuous surface without hills and valleys.

In contrast to the reciprocating movement of a piston, a rotary drive element in this invention will turn in the same direction at all times without any chamber wall impediments to slow, impede or divert its path.

The smooth, continuous chamber wall translates into less friction, heat, and wear on the seals.

The rotary drive element moves freely on the shaft without the need for expensive gear teeth and attendant gear systems.

The simple design of the rotary drive element reduces the steps needed for its manufacture.

The particular positioning of the shaft allows the two apices of a free-sliding rotary drive element to remain in continuous contact at all times with the opposite walls of the chamber. This dispenses with the need for an expensive eccentric system that in other designs allows a rotor to enter recessed chamber areas.

Inasmuch as the rotary drive element's apices sweep the entire surface of the chamber wall during the course of a revolution, there will be a continuous self-cleaning effect. Reduced engine performance due to carbon build-up is thereby eliminated, along with costly service or repairs.

The unique shape of the chamber, in combination with the free movement of the rotary drive element on the shaft, allow for the continuous creation and dissolution of a large area for intake/exhaust, and a small area for compression/ignition. This dispenses with the need for supplementary recesses either in the chamber wall or on the rotor faces.

The power-output shaft design is straightforward. It is anticipated that manufacturing this invention's shaft will be less complicated and less expensive than a conventional rotary engine eccentric shaft.

It is projected that the horsepower generated by this invention will be six times that of a conventional internal combustion piston-type engine for the same size.

Should a manufacturer desire to operate this invention in a counterclockwise direction, a mirror image of the chamber pattern will yield the desired result.

The rotary engine of the present invention is free of ambiguities and free of circuitous measures. It is simple, easy to implement, and economical to manufacture.

The objects and advantages mentioned above will become clearly evident through the following detailed description of the invention, its many embodiments, and its operation. Other objects and advantages will become apparent from the detailed description of the invention and the drawings. The method whereby the inventor created the required design for the chamber, rotor, and power-output shaft is explained in detail forthwith:

SUMMARY OF THE INVENTION

In accordance with an embodiment of the present invention a rotary internal combustion diesel engine capable of additional embodiments comprises a housing containing a cavity of a particular design, a two-apex rotary drive element, a power-output shaft, a fuel supply system, air-intake and gas-exhaust channels, and where required by alternative embodiments, an ignition source or input/output ports.

LIST OF PARTS AND THEIR REFERENCE NUMBERS

Figure 23:
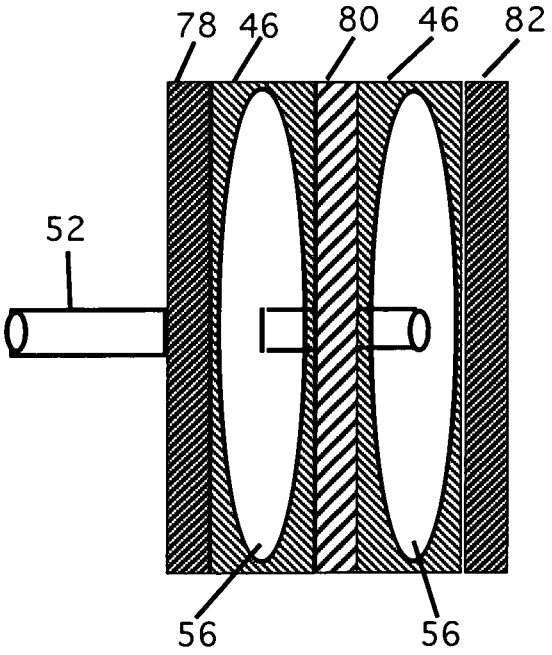
FIG. 23 shows a side view of two outer rotor housings 46 coupled onto a single power-output shaft 52.

30. Yousroid Pattern-Making Device
32. Platform
32*a*. Bolt
32*b*. A sheet of paper, vellum or other suitable drawing surface.
34 Large wheel
34*a*. Center of large wheel 34
36. Small wheel
36*a*. Support shaft for small wheel
36*b*. Small wheel aperture
38. Armature
38*a*. Slot to hold ball bearing support post 42*a*
38*b*. Slot to hold writing instrument 44
40. Spring
42. Ball bearing
42*a*. Ball bearing support post
44. Writing instrument
44*a*. Hex screw
46. Outer rotor housing (FIGS. 5, 23, 27)
48. Yousroid cavity and/or chamber
48*a*. Larger yousroid sub-chamber space
48*b*. Smaller yousroid sub-chamber space
48*c*. Yousroid chamber wall
50. Generating point
50*a*. Center of small wheel 36
52. Power-output Shaft (FIGS. 23, 24, 28)
54. Rectangular segment on power-output shaft (FIGS. 24, 28)
56. Rotor
58. Aperture in rotor
60. Rotor apex one
62. Rotor apex two
64. Rotor face one
66. Rotor face two
68. Air-intake channel with valve
70. Exhaust channel with valve
70*a*. Output port (FIG. 26)
72. Fuel supply device
74. Input port (FIG. 26)
76. Ignition device (FIG. 25)
78. Posterior cover plate (FIG. 23)
80. Intermediate partition plate (FIG. 23)
82. Anterior cover plate (FIG. 23)

DETAILED DESCRIPTION OF THE INVENTION

A significant feature embodied in this invention is the unusual shape of the engine's working chamber 48. This unique shape has not, to this applicant's knowledge, been discussed in any rotary engine prior art or publication; therefore, it seems necessary to define several terms relating to this invention, namely: "acentric," "circleoid," "generating point," "yousroid," and "vesica piscis."

Definition of "acentric:" 1. "Destitute of a centre." (From: The Oxford English Dictionary, Oxford University Press, second edition, 1991. Vol. 1, pg. 96, col. 2.); 2. "Without a centre." (From: Shorter Oxford English Dictionary. Oxford University Press, 2007, Vol. 1, pg. 17, col. 2.)

Definition of "circleoid:" "A closed, acentric plane figure resembling a circle." The invention described in this patent application relates to a particular kind of circleoid, here referred to as a "yousroid."

The term "generating point" refers to the location from whence the perimeter of a "yousroid," the chamber in this invention, is drawn. As the center of a circle is the point round which a circle is described by compasses, so the generating point is the location about which a yousroid is described by the pattern-making device detailed below.

Figure 4:
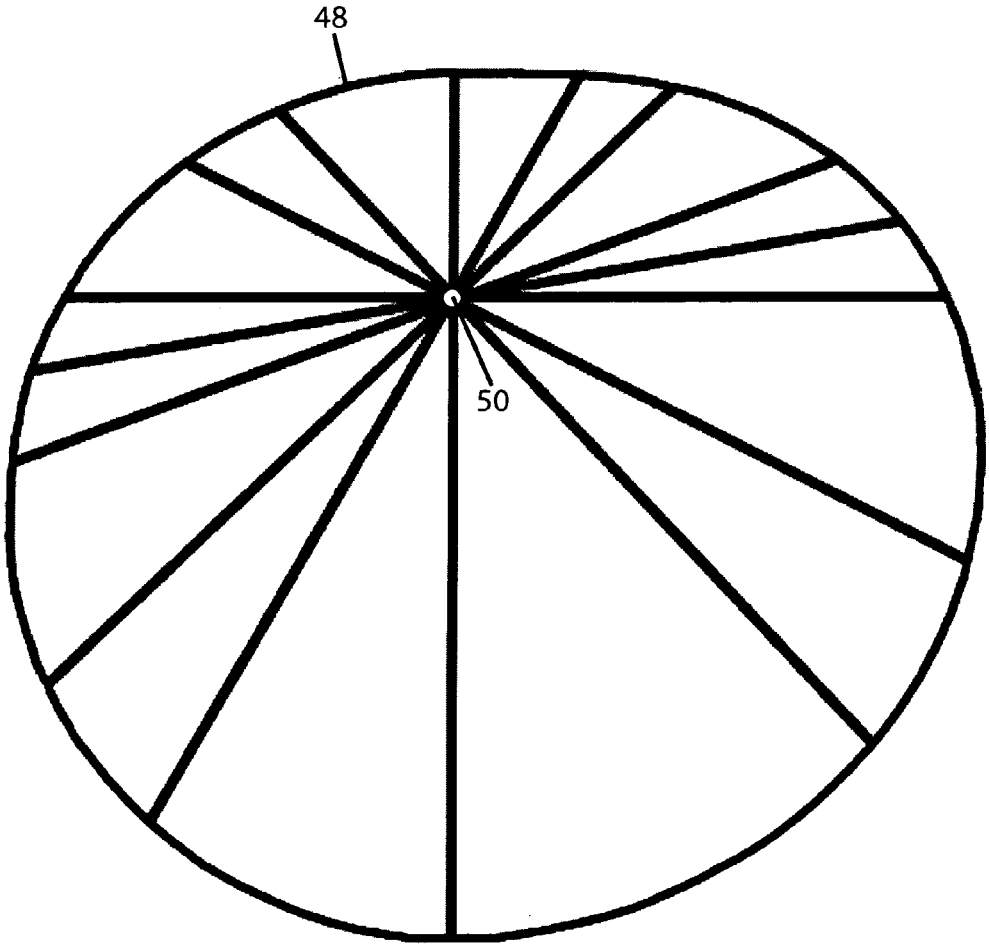
FIG. 4 is a cross section of yousroid chamber showing location of generating point 50.

Definition of "yousroid:" "An acentric plane figure having a boundary or perimeter in the shape of a circleoid, characterized in that it contains a generating point so that all straight lines drawn through the figure, stretching from boundary to boundary, and also passing through the generating point, will be exactly the same length whether the lines be horizontal, vertical, or at any intermediate angle." FIG. 4 illustrates a yousroid with eight straight lines passing through the generating point and extending from boundary to boundary, all lines being of the same length. These lines are indicative of the projected path of a single rotor as it turns within a yousroid chamber. In this document the term "yousroid" is used: first, to denote a two-dimensional pattern; second, to denote a three-dimensional cavity having a yousroid profile nested inside of an outer housing; and third, when an outer housing containing a yousroid cavity is encapsulated on all sides, to denote a chamber.

In this invention, the generating point plays a role in determining the exact location of the power-output shaft's axis. A second characteristic of the generating point is that it divides every straight line of identical length passing through it into two segments. Due to the location of the generating point within the yousroid, one segment is always longer than the other segment. Within an engine setting, one such a line translates into a rotor having unequal segments on either side of the generating point, which when turning, always remains in contact with the opposite boundaries of the yousroid, and always rotates in the direction of the longer segment due to its heavier weight and the resulting leverage. In the accompanying drawings, the rotor will always turn in a clockwise direction.

Definition of "vesica piscis:" "A pointed oval figure typically composed of two intersecting arcs." (From: Webster's Third New International Dictionary of the English Language, Unabridged, 2002. P. 2546, col. 3.)

Figure 1:
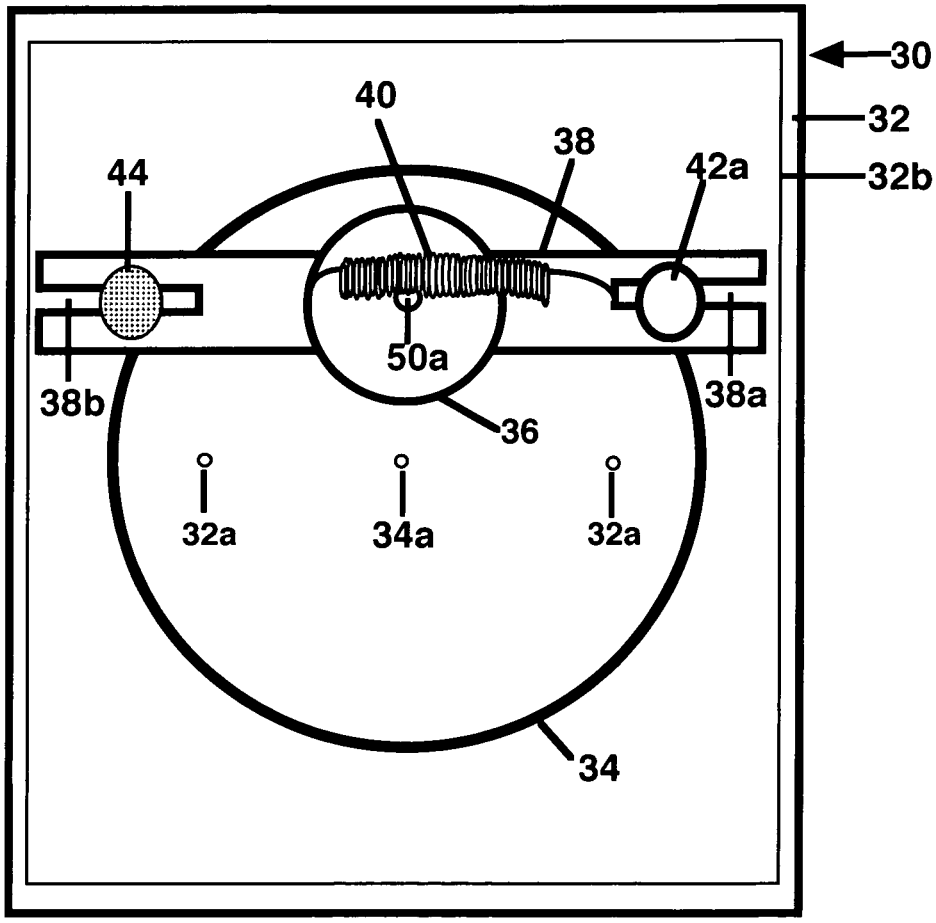
FIG. 1 is a top view of yousroid pattern-making device 30.
Figure 2:
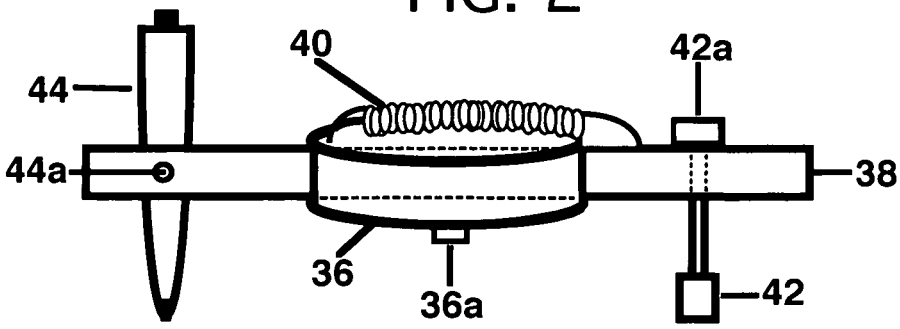
FIG. 2 is a side view of armature 38 and its attachments.
Figure 3:
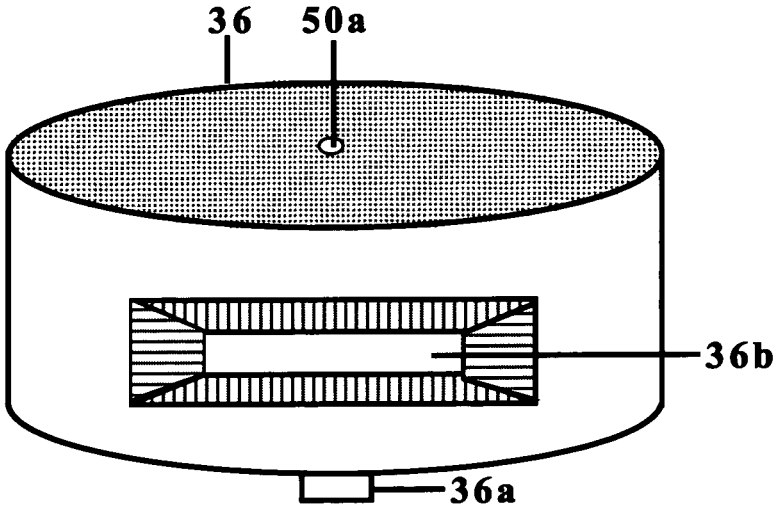
FIG. 3 is a side view of the small wheel on the yousroid pattern-making device.

Components of the Yousroid Pattern-Making Device (FIGS. 1, 2, and 3)

In order to determine the precise shape of a yousroid chamber, it was first necessary to invent an instrument that would accomplish the task. The resulting invention that draws a yousroid pattern 30 is presented along with a detailed explanation of its components:

1. Platform.

A sheet of Plexiglas, wood or other suitable substance serves as a platform 32 for the device 30. There is a plurality of holes to bolt 32*a* the large wheel 34 to the platform 32. On the underside of the platform 32 there is a small hole directly under the center point of the small wheel 36.

2. Large Wheel.

The large wheel 34 may be variable in diameter and of a visible thickness. The size of the large wheel 34 will ultimately be based upon decisions made concerning the size of the engine chamber 48 because the diameter of this wheel 34 is the main factor determining the size of the pattern drawn on a sheet of paper, vellum, or other suitable drawing surface 32*b*, and therefore the size of a resulting chamber 48 and most importantly, the consequent power of an engine based on the pattern.

3. Small Wheel.

A small wheel 36 is of sufficient thickness to adequately house an aperture 36*b* or tunnel passing from side to side through its center. The small wheel is positioned on a centered stationary but rotatable support shaft 36*a* above the large wheel 34 at a previously determined location.

The center 50*a* of the small wheel 36 must be located within the circumference the larger wheel 34, but in an eccentric position; that is, in any location except the center 34*a* of the large wheel 34. The exact placement of the small wheel's center support shaft 36*a* will depend on the compression ratio one wants to achieve. The closer the small wheel 36 is to the center 34*a* of the large wheel 34, the lower the compression ratio. The further away the small wheel 36 is from the center 34*a* of the large wheel 34, the higher the compression ratio.

The diameter of the small wheel 36 is less critical than the large wheel's 34 diameter. The small wheel's 36 main function is first, to serve as an anchor for the armature 38 and second, the center 50*a* of the small wheel will identify the location of the generating point 50 on the yousroid pattern.

4. Armature.

An armature 38 made from a rectangular block has a slot 38*a* on one end holding a permanently mounted ball bearing 42 on a support post 42*a*, and on the other end, a slot 38*b* to fit a writing instrument 44 held firmly in place with a hex screw 44*a*. Inasmuch as the armature 38 sits in the aperture 36*b* running through the center of the small wheel, it will, when turned, mimic the path of a rotary drive element within a yousroid chamber. The length of the armature 38 is sufficient to extend beyond the perimeter of the large wheel 34 in both directions.

5. Ball-Bearing and Support Post.

A post 42*a* is attached to one end of the armature 38 to which a ball bearing 42 has been attached. The ball bearing 42 remains in a stationary but rotatable position, extending just beyond and below the side edge of the large wheel 34, and able to turn as it glides around the rim of the large wheel 34 as the armature 38 is turned.

6. Spring.

A spring 40 is attached to the edge of the armature 38 on side holding the ball bearing 42. The other end of the spring 40 is attached to the edge of the small wheel 36. The purpose of the spring 40 is to provide tension and keep the ball bearing 42 in constant contact with the side edge of the large wheel 34 as the armature 38 is turned.

7. Writing Instrument.

An instrument for writing or drawing 44 is attached to the other end of the armature 38, and a sheet of paper 32*b* is placed between the large wheel 34 and the platform 32 to capture the chamber pattern drawn using the device 30.

Preparation of Yousroid Pattern-Making Device

The yousroid-making device 30 is prepared for use as follows: A sheet of paper 32*b* is placed on the platform 32 of about the same size. The large wheel 34 is then mounted on top of the paper and bolted through the paper to the platform 32. The large wheel 34 remains in a fixed position and does not rotate. The small wheel 36 previously mounted on the large wheel is in an off-center position relative to the center of the large wheel 34. This small wheel 36 will remain stationary in the designated position but will rotate 360°. The armature 38 with the ball bearing 42 on one end is inserted through the tunnel in the center of the small wheel 36. A writing instrument 44 is inserted into the slot 38*b* on the opposite end of the armature 38, in such a way that the writing instrument's point 44 makes contact with the sheet of paper 32*b* on the platform 32, with the point 44 hugging the rim of the large wheel 34 so that the pattern drawn will precisely reflect the path of the writing instrument 44.

Throughout the chamber pattern-making process both the large wheel 34 and the small wheel 36 remain in a stationary position. However the small wheel 36 does rotate, and along with it the armature 38, the writing instrument 44, and the ball bearing 42. The armature 38 will trace the path of the first true rotor and thereby define the shape of the chamber 48. Of necessity the armature 38 is longer than an actual rotor because it must extend beyond the circumference of the large wheel 34 on opposite sides in order to support attachments 42 and 44. The segment of the armature 38 that lies between the writing instrument 44 and ball bearing 42 will replicate the path of the eventual rotor 56. As indicated earlier, the large wheel 34 has a noticeable thickness; this thickness allows the ball bearing 42 to move around the outer edge (or rim) of the large wheel 34 without slipping and thereby control the movement of the writing instrument 44 located on the other end of the armature 38. The small wheel 36 contains an aperture 36*b* running through the side from end to end, and passing through the center. The armature 38 is inserted into this aperture 36*b* and slides freely: this free movement allows the ball-bearing 42 end of the armature 38 to move around the circumference of the large wheel 34, causing the writing instrument 44 to move and trace a pattern. The distance between the side edge of the ball bearing 42 and the tip of the writing instrument 44 is exactly the same length as the eventual rotor 56.

On the underside of the platform 32 is a small hole at the exact center 50*a* of the small wheel 36. This precise spot is the generating point 50 for the yousroid chamber 48.

Drawing a Yousroid Chamber Pattern

Using FIG. 1 as a guide, drawing a yousroid chamber pattern with the above-described device 30 proceeds as follows:

First, the operator places a sheet of paper 32*b* between the large wheel 34 and the platform 32. Second, the operator then uses a writing instrument to trace (counterclockwise) the left hemisphere of the large wheel, from top to bottom, onto the paper. This step is accomplished without the use of the armature 38. Third, the operator now checks to see that the ball bearing 42 and writing instrument 44 attached to the armature 38 are in their proper positions abutting the large wheel, with the writing instrument 44 positioned at the top of the large wheel 34. Then the operator turns the armature 38 to the right (clockwise) until the writing instrument 44 reaches the bottom of the large wheel 34 and connects to the tracing made in step two. The ball bearing 42 and the spring 40 control the path of the armature 38. The path of the ball bearing 42 is determined by its contact with the thick circumferential edge or rim of the large wheel 34. As the armature 38 turns clockwise without slipping, the writing instrument 44 begins to trace the right-hand portion of the pattern onto the sheet of paper 32*b*. When the tip of the armature 38 supporting the writing instrument 44 reaches the bottom of the large wheel 34, the writing instrument 44 will have inscribed a pattern (yousroid) onto the paper that becomes the basis for manufacturing the internal shape of the chamber 48 for the rotary engine.

Upon completing the drawing the pattern maker turns the device 30 upside down and makes a mark or indentation on the reverse side of the paper 32*b* through a small hole 50*a* under the exact center of the small wheel 36. The use of a transparent material such as Plexiglas as a platform will help if it is necessary to drill a hole. The mark or indentation, while small, should be visible on the obverse side of the paper 32*b*, along with the yousroid pattern. This location is referred to as the generating point 50, here marking the exact center 50*a* of the small wheel 36 on the yousroid pattern-making device 30. The generating point 50 is the location where the axis of a power-output shaft 52 must be located. Since the small wheel 36 rotates on its own axis but is otherwise stationary, there can be only one particular location for the placement of a shaft 52. No other location will permit a rotor 56 to rotate on a shaft 52 within a yousroidal chamber 48. This step completes the use of a yousroid-making device 30. The pattern can now be transferred to the appropriate manufacturing equipment to make a yousroid cavity and chamber 48.

Major Components of a Yousroid-Based Rotary Engine, Pump, or Motor

1. An Outer Engine Housing.

This term references the housing 46 that contains a yousroid cavity 48, intake 68 and exhaust 70 channels, a fuel supply 72, and in a gasoline embodiment, an ignition device 76. Two or more outer housings can be linked together to form an extended engine block.

2. A Yousroid Chamber.

The yousroid cavity 48 is located within the outer engine housing. The terms "cavity" and "chamber" refer to exactly the same space within the outer housing 46, with the refinement being that the cavity becomes a yousroid chamber 48 when it is sandwiched between two of the three plates (anterior 82, intermediate 80, or posterior 78). The height, width, depth, and therefore the volume of the chamber 48 are engineering and manufacturing decisions.

3. A Rotor.

This invention features an inner body, often referred to as a rotational body, or simply as a rotor 56, being of a substantially vesica piscis profile, having two-apices 60 and 62, and two convex faces 64 and 66, each face functioning as a piston. At each apex there will be a prior art sealing mechanism (not shown) that pushes a seal against the wall of the chamber 48 to create an airtight fit. The apex seals are in slidable contact with the yousroid chamber wall 48*c* of the rotor housing 46. The yousroid chamber wall 48*c* of the rotor housing 46, the inner surface of the intermediate partition plate 80, the inner surfaces of the anterior plate 82 and/or posterior plate 78 and rotor faces one 64 and two 62 define two working sub-chambers 48*a* and 48*b* within the yousroid chamber 48.

Figure 5:
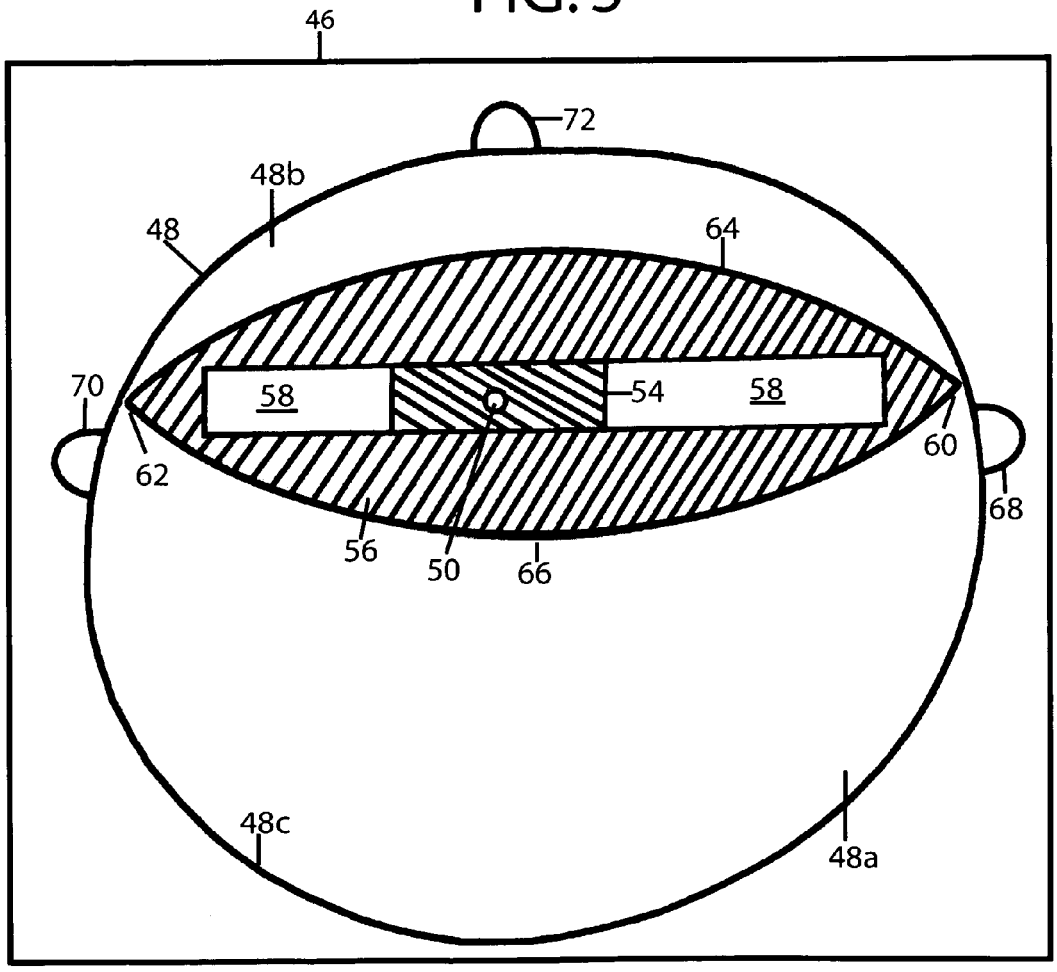
FIGS. 5-22 show a cross-section of a yousroid chamber 48 with a rotor 56 in various positions during the course of a complete cycle.

Referring to FIG. 5, the rotor 56, when in a horizontal position, divides the chamber 48 into two unequal spaces. These two sub-chamber areas vary in size and volume as the rotor 56 turns, and are most clearly noticeable and functionally important when the rotor reaches a horizontal position; that is, when one rotor apex 60 or 62 is positioned just above the air intake channel 68 and the other rotor apex 60 or 62 is positioned just above the exhaust channel 70. This variableness is an important feature allowing the chamber 48 and rotor 56 to work together to the advantage of this design: the larger yousroid sub-chamber space 48*a* in the region below the generating point 50 handles both air intake and the expulsion of combusted gases; the smaller yousroid sub-chamber space 48*b* in the region above the generating point 50 and opposite the fuel supply system 72 handles compression, fuel intake, ignition, and combustion. When the rotor 56 is in a vertical position, there are chambers on either side of the rotor 56 performing important functions, but these are considered phases in the sweeping motion of the rotor 56 that precede and succeed combustion.

The rotor 56 will contain at least one oil passageway (not shown) that will lubricate the seals (not shown) on the apices 60 and 62 with oil entering into the passageway from the power-output shaft 52.

Figure 24:
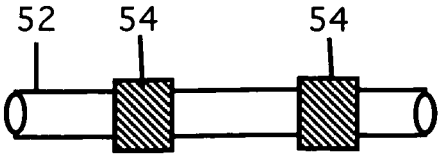
FIG. 24 shows a side view of power-output shaft 52.

The rotor 56 will sit on a rectangular segment 54 of the shaft 52 (FIG. 24). An aperture 58 running longitudinally along the middle of the rotor 56 will allow it to both rotate and slide from side to side on the shaft 52. The length and width of the aperture 58 will depend on several factors, including the dimensions of the rectangular segment 54 of the shaft 52, and allowance for expansion of the rectangular segment 54 due to a rise in temperature during operation. There will be a sufficient gap in the aperture 58 to allow the rotor 56 to slide from side to side on the shaft's 52 axis. The rotor 56 cannot become dislodged from the shaft 52 because the anterior and posterior cover plates will prevent the rotor 56 from slipping off the shaft 52, and in combination with seals (not shown), keep the chamber 48 airtight. As the rotor 56 both rotates and moves from side to side, the seals in the two apices 60 and 62 will remain in constant contact with the yousroid chamber wall 48*c* of the chamber 48.

4. An Air Intake Channel with Valve

In a diesel or a gasoline embodiment of this invention, an air-intake channel with valve 68 is located in the wall of a stationary yousroid chamber and rotor housing 46 just below the horizontal position of a rotor 56, as shown in FIG. 5. The valve 68 is opened and closed with a cam (not shown) mounted on the power-output shaft 52 or it can be spring-loaded (not shown) and operate on negative air pressure. This engine component will be based on prior art. It is referenced abstractly in the drawings to identify its location in the larger yousroid sub-chamber 48*a* region and in relation to other engine components.

5. Input Port

Figure 26:
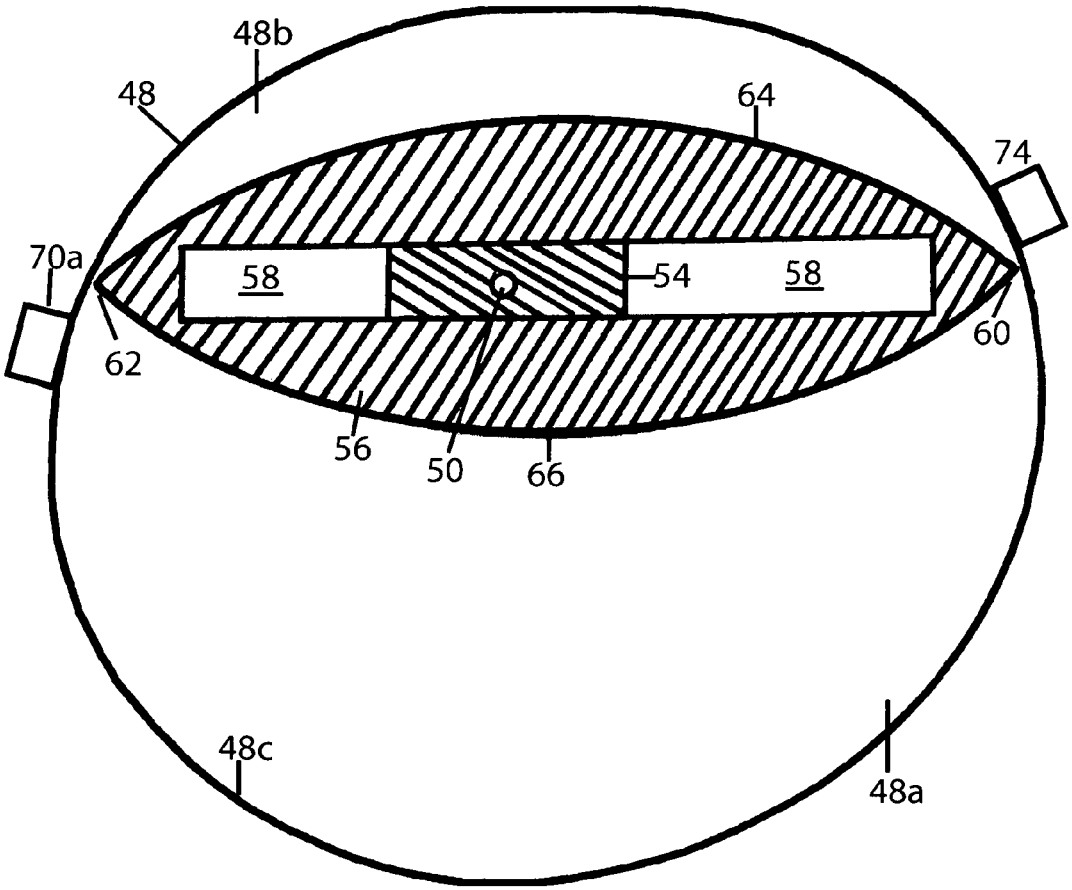
FIG. 26 shows a cross section of a pump or motor embodiment, primarily indicating the position of an input port 74 and an output port 70*a*.

In place of an air-intake channel with valve, certain embodiments that do not function as internal combustion engines, such as a compressed air motor, a hydraulic motor, a steam engine, a hydraulic pump, an air pump, a fluid pump and a fuel pump among others, may require an input port 74, as shown in FIG. 26, located in the wall of a stationary yousroid chamber and rotor housing 46, such that when the rotor 56 is in a horizontal position, the input port 74 is positioned on the right-hand side, just above the rotor apex 60 or 62. This engine component will be based on prior art. It is referenced abstractly in the drawings to identify its location in the smaller yousroid sub-chamber 48*b* region and in relation to other engine components.

6. A Fuel Supply Device

Diesel and gasoline embodiments of this invention require a fuel supply device 72 such as a fuel injector. Referring to FIG. 5, the top of the yousroid chamber 48 is provided with a fuel supply device 72. The fuel supply device 72 is installed so as to face on the smaller yousroid sub-chamber space 48*b*, such that the fuel supply device 72 can directly insert fuel into the smaller yousroid sub-chamber space 48*b*. Other embodiments, such as a compressed air motor, a hydraulic motor, a steam engine, a hydraulic pump, an air pump, a fluid pump, and a fuel pump among others, do not require a fuel supply device. This engine component will be based on prior art. It is referenced abstractly in the drawings to identify its general location in the smaller yousroid sub-chamber 48*b* region and in relation to other engine components.

7. An Exhaust Channel with Valve

Referring to FIG. 5, diesel and gasoline embodiments of this invention require an exhaust channel with valve 70 located in the wall of a stationary yousroid chamber and rotor housing 46, positioned just below a rotor apex 60 or 62 when the rotor 56 is in the horizontal position. The exhaust channel with valve 70 is opened and closed with a cam (not shown) mounted on the power-output shaft 52. The disposal of exhaust once it exits the yousroid chamber 48 will be accomplished through the use of prior art technology. This engine component will be based on prior art. It is referenced abstractly in the drawings to identify its location in the larger yousroid sub-chamber 48*a* region and in relation to other engine components.

8. An Output Port

In pump and non-combustive motor applications, gases and fluids are removed through an output port 70*a*. The disposal of these gases and fluids once they exit the yousroid chamber 48 will be accomplished through the use of prior art technology. This output port will be based on prior art. It is referenced abstractly in the FIG. 26 to identify its location in the larger yousroid sub-chamber 48*a* region and in relation to other engine components.

9. An Ignition Device

Figure 25:
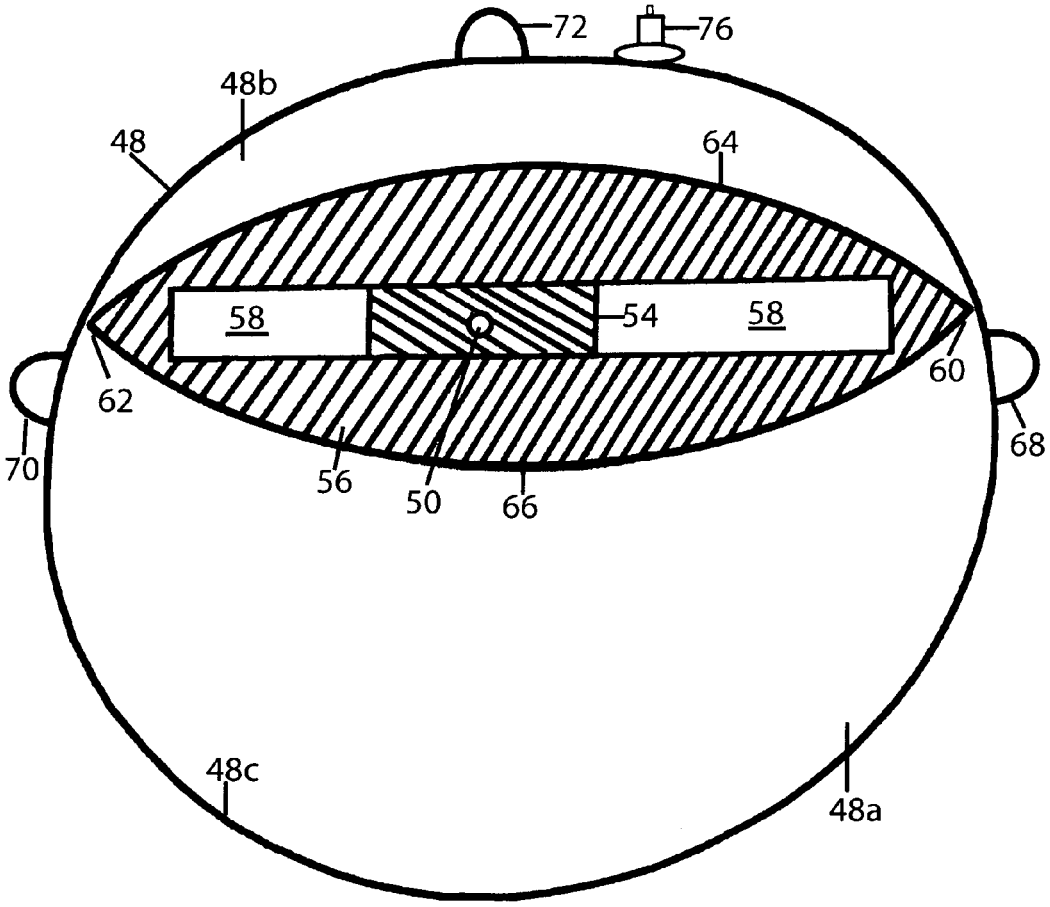
FIG. 25 shows a cross section of a gasoline engine embodiment, with addition of an ignition device 76.

A gasoline embodiment of this invention requires an ignition device 76. The ignition device may consist of any suitable method to ignite the fuel in the yousroid compression/combustion sub-chamber by means of an electrical spark or heat. Referring to FIG. 25, an ignition device 76 appears at the top of the yousroid chamber and rotor housing 46. The ignition device 76 is installed so as to face onto the smaller yousroid sub-chamber space 48*b*, such that the ignition device 76 can directly ignite fuel in the smaller yousroid sub-chamber space 48*b*. The preferred ignition system is that commonly utilized in automobiles consisting of a storage battery, generator or alternator, and a timing device such as a distributor or an electronic timing device which are connected by wires to one or more spark plugs, depending upon the number of yousroid rotor housings combined into a single engine block. Other embodiments, such as a diesel engine, a compressed air motor, a hydraulic motor, a steam engine, a hydraulic pump, an air pump, a fluid pump, and a fuel pump among others, do not require an ignition device 76 or an ignition system. This engine component will be based on prior art. It is referenced abstractly in the FIG. 25 to identify its general location in the smaller yousroid sub-chamber 48*b* region and in relation to other engine components.

10. A Power-Output Shaft

The power-output shaft 52 on the current invention is a cylindrical rotating rod containing straightforward, simple shaft construction in comparison with a crank or eccentric shaft. The shaft will pass through the posterior plate 78, yousroid chamber and rotor housing(s) 46, intermediate plate(s) 80, and anterior plate 82 at the location designated as the "generating point" 50 in FIG. 5. There will be a cam (not shown) to operate the exhaust valve 70, which opens for one full rotation every two rotations. Therefore, there will be an external timing belt and gear (not shown) to reduce the speed of the cam to 50 percent of the regular speed of the output shaft. The exhaust valve 70 must be periodically closed because the compression phase takes place in the same vicinity, and if the exhaust valve 70 remains open, compression is lost. The intake valve can also operate with a cam (not shown), or can be spring loaded and work with negative pressure. Such a spring-loaded air-intake valve (not shown) would allow air to enter the working chamber 48 but would not allow it to escape back through the intake valve 68.

The power-output shaft 52 will contain appropriately placed essentially rectangular segments 54 upon which each rotor 56 is located. This rectangular segment 54 is a little larger than the shaft 52 itself. The shaft 52 can be machined so that the cylindrical portions are slightly smaller than the rectangular segments 54, thereby facilitating the placement of the rotor(s) 56 on the shaft. As mentioned above, the two-apex rotor 56 is designed with an aperture 58 running lengthwise that fits onto the shaft 52 and allows sufficient additional clearance for rotor 56 movement. With this construction, the rotor 56 will continuously adjust its position on the shaft 52 as required when the rotor 56 passes through the wider and narrower areas of the chamber 48. Furthermore, this arrangement will allow both ends of the rotor 56 to remain in tight contact with the yousroid chamber wall 48*c*. The power-output shaft can be a single unit, or comprised of a multiplicity of coupled shafts.

The power-output shaft will have a system (not shown) external to the shaft that provides a cooling medium and a lubrication medium to channels (not shown) in the shaft. An appropriate cooling and lubrication media can enter the portions of the shaft on which the rotor sits via small channels (not shown) in the rotor. The lubrication medium will move by centrifugal force into the opposite ends of the rotor and passing through small channels, will cool and lubricate the rotor seals. The shaft will sit on a plurality of sleeve bearings (not shown), and will be cooled and lubricated by an appropriate medium via channel(s) (not shown) inside the shaft.

Compression as a Factor of Chamber and Rotor Design

This compression ratio in this invention can be adjusted in two ways: First by changing the distance between the center point of the large plastic wheel 34 and the center point of the small wheel 36 on the yousroid pattern-making device 30, and second, by making the two faces of the rotor 56 either more convex, or less convex. From this perspective, a rotor 56 substantially in the shape of a vesica piscis is superior to the traditional triangular rotor because it produces higher torque. The symmetric curves connecting the two apices can be fine tuned and calibrated to eliminate the problem of poor compression ratio inherent in the Wankel design. The more convex the rotor 56, the higher the compression ratio; the less convex the rotor 56, the lower the compression ratio. Furthermore, this two-apex rotor 56 can be designed and built to combust diesel fuel whereas the Wankel engine has not been successful in a diesel engine configuration. Cold starting a low compression ratio diesel Wankel is another problem, even with a heat input aid. However, the engine described in this document will have a high compression ratio and therefore the problems inherent in Wankel diesel engines will be successfully resolved. The same techniques used to start other diesel engines will be applied to starting this engine. There will be an external electric starter (not shown) and any additional prior art technology required by the manufacturer.

Vibration as a Factor of Chamber and Rotor Design

It is anticipated that embodiments of the present invention will offer a virtually vibration-free performance. Chamber and rotor will function almost as smoothly as an electric motor because there is no oscillation of any kind, and the internal wall of the chamber comes as close as possible to approximating a smooth circular chamber and still accommodate a spinning rotor without the need for any vibration-inducing impediments.

Description of a Yousroid Pattern-Making Device

FIG. 1 shows a top view of the device 30 used to draw a pattern for the combustion chamber 48. The yousroid pattern-making device comprises a platform 32, a large wheel 34, a small wheel 36 and an armature 38 inserted into the small wheel 36. A spring 40 provides tension to keep a ball bearing 42 in constant contact with the outer edge of the large wheel 34.

FIG. 2 shows a side view of the armature 38 with a ball bearing 42 on one end and a writing instrument 44 on the other end.

FIG. 3 is a side view of the small wheel on the yousroid pattern-making device, highlighting the aperture 36*b* or tunnel into which the armature 38 of the pattern-making device 30 is inserted.

FIG. 4 shows a cross sectional view of a yousroid chamber 48. Note that eight lines have been drawn at various angles, all crossing through generating point 50 and all lines touching opposite inner walls of the chamber 48. Every line is exactly the same length, indicating that a rotor 56 of the same length as these lines, and positioned on generating point 50, would have its apices in contact with the chamber 48 wall in any angle at all times.

Description of a Diesel Engine Embodiment and Operation

A diesel engine embodiment will consist of an outer housing, yousroid chamber, rotor, power output shaft, air intake and exhaust channels configured as shown in FIG. 5. An exemplary embodiment would consist of at least two outer housing units and their components combined into a single engine block sharing one power-output shaft.

FIG. 5 shows the rotor 56 at rest in a horizontal starting position. Although the rotor 56 is horizontal, the space in the aperture 58 is greater between rectangular shaft segment 54 and rotor apex one 60 than between shaft segment 54 and rotor apex two 62. Upon combustion, this difference in length and leverage will cause the rotor 56 to turn clockwise. With the rotor 56 in a horizontal position, the larger yousroid sub-chamber space 48*a* and the smaller yousroid sub-chamber space 48*b* are clearly defined.

Figure 6:
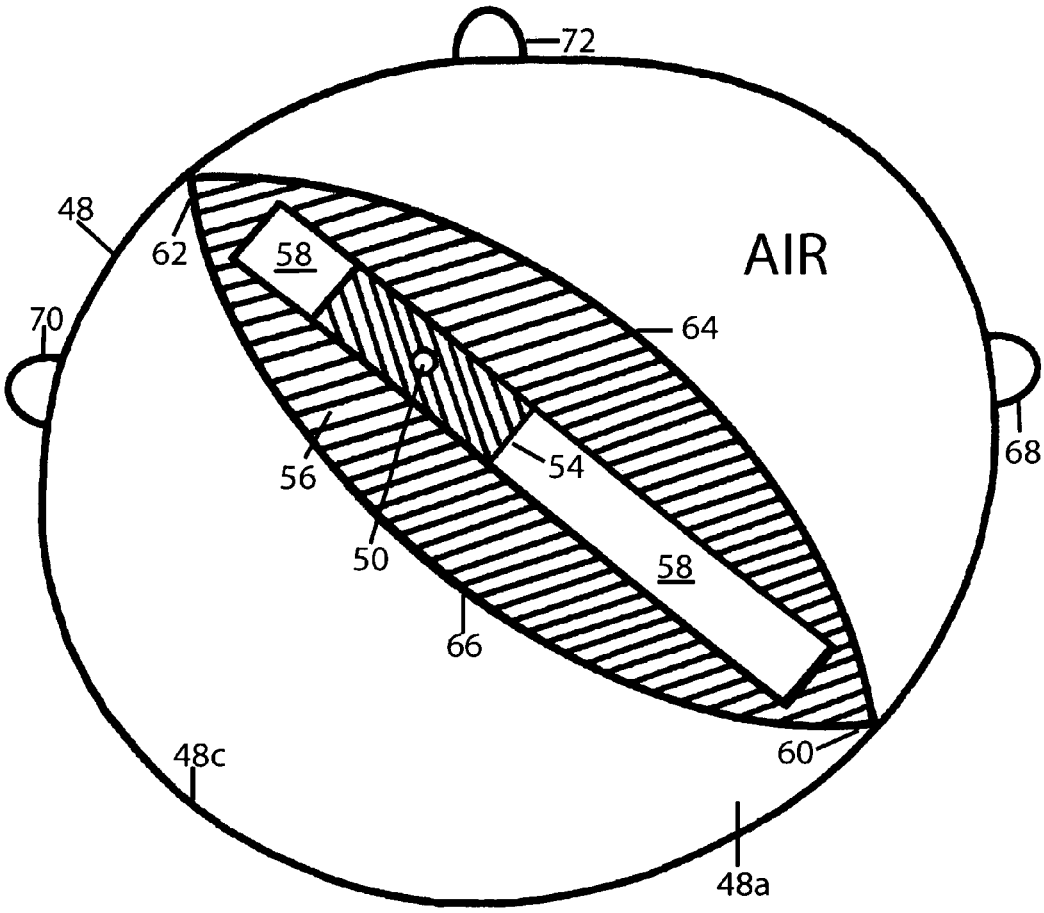

FIG. 6 shows the rotor 56 just starting to turn clockwise and has reached a 45° angle relative to the horizontal starting position. On the right-hand side rotor apex one 60 has just passed by the air intake valve 68, an action that draws air into the space opposite rotor face one 64. On the other side of the rotor 56, opposite rotor face two 66, residual air is expelled through exhaust valve 70.

Figure 7:
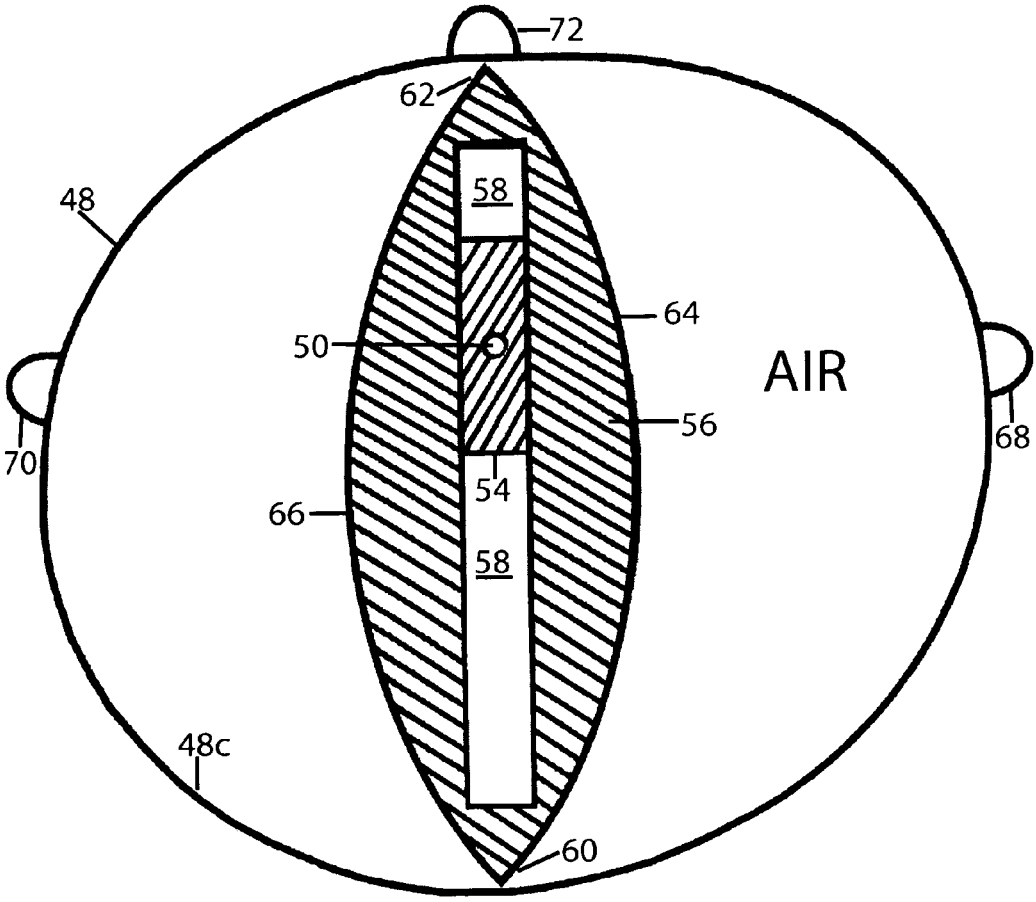

FIG. 7. The rotor 56 is now in a completely vertical position, at a 90° angle with respect to the horizontal starting position and is still drawing air from the air intake valve 68 while the rotor 56 continues turning clockwise. In this position most of the rotor's 56 aperture 58 is below the shaft segment 54. However, a small portion of aperture 58 is above the shaft segment 54, showing that rotor 56 has clearance; that is, the shaft segment 54 does not touch the top wall of aperture 58. Fully half of the chamber 48 is filled with fresh air on the side between rotor face one 64 and the chamber 48 wall.

Figure 8:
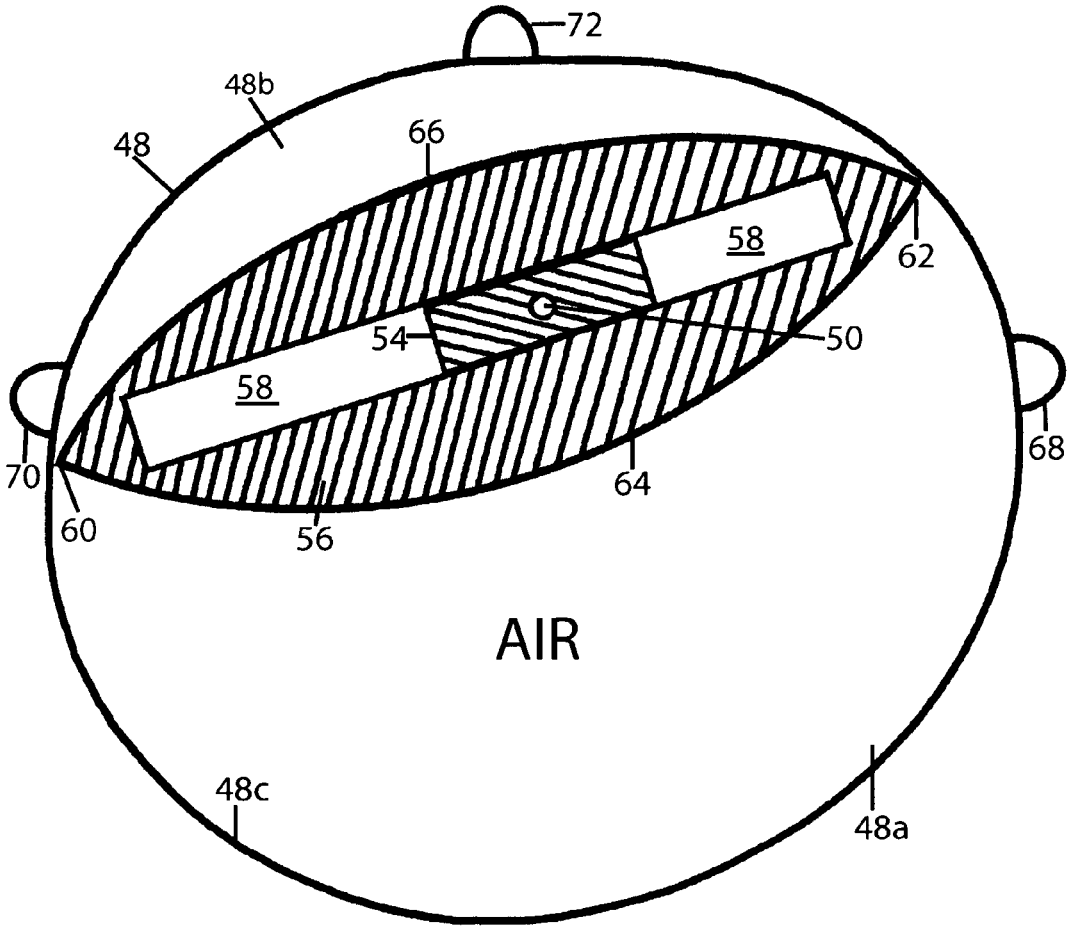

FIG. 8. The rotor 56 is now at a 135° angle relative to the horizontal starting position and air continues to be drawn into the right-hand side of the chamber 48 opposite rotor face one 64, which continues to grow in size.

Figure 9:
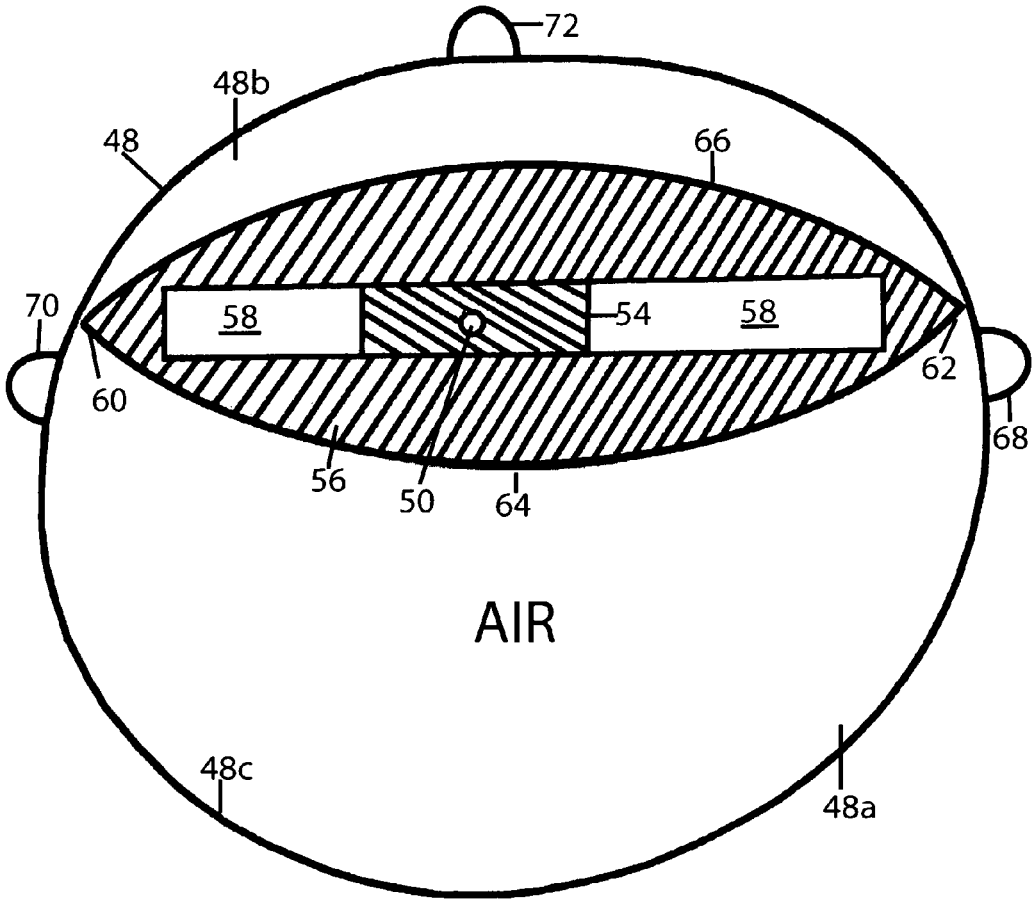

FIG. 9. The rotor 56 reaches a horizontal position; at this point the maximum amount of air has been drawn into the larger yousroid sub-chamber space 48*a*, which lies between rotor face one 64 and the lower portion of the yousroid chamber wall 48*c*. Rotor apex two 62 is now on the right-hand side and rotor face two 66 is in the smaller yousroid sub-chamber space 48*b* opposite the top chamber 48 wall.

Figure 10:
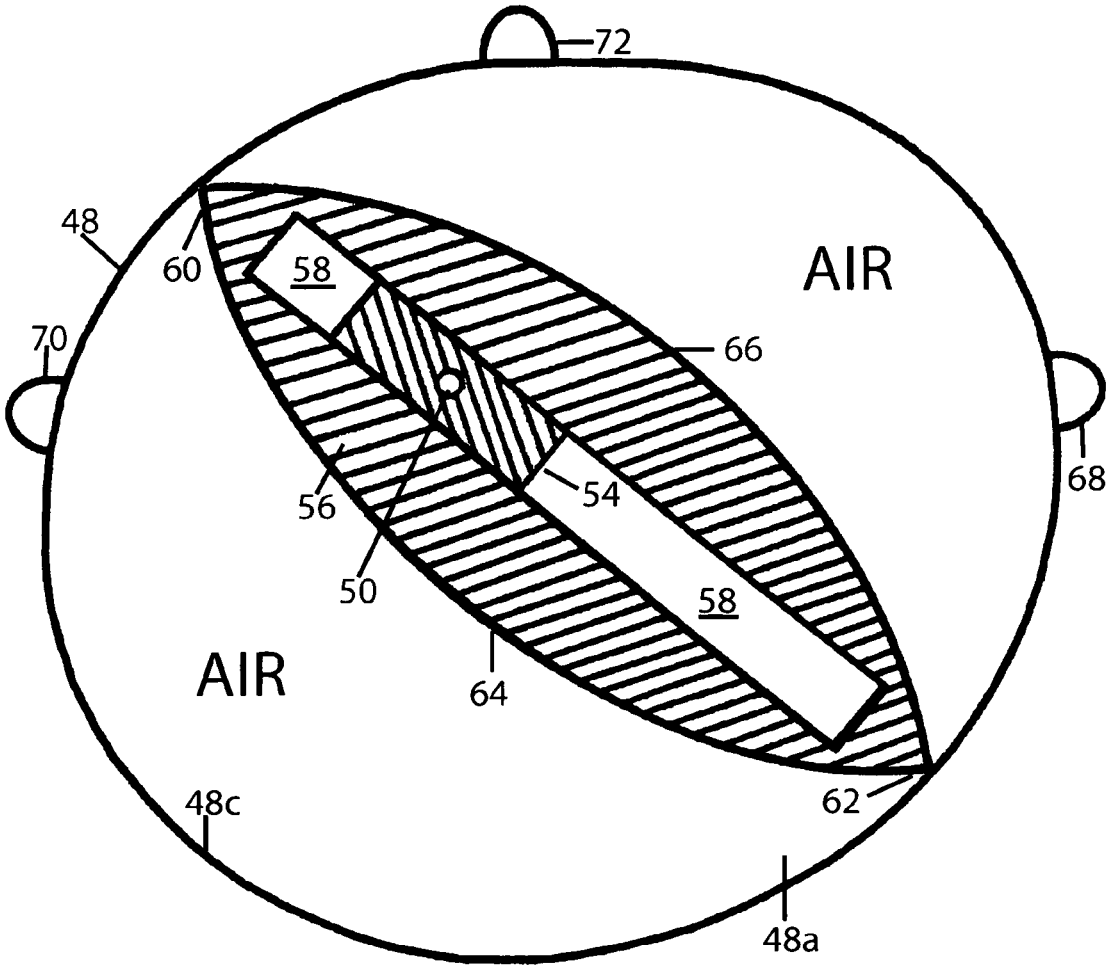

FIG. 10. The rotor 56 is at a 45° angle with respect to the horizontal starting position. The rotor 56 continues turning clockwise and rotor apex two 62 passes the air-intake valve 68 at which point a second mass of air is being drawn into the chamber 48 between rotor face two 66 and the internal wall of the chamber 48. On the other side of the rotor 56, at rotor face one 64, the first mass of air begins to get compressed between rotor face one 64 and the internal wall of the chamber 48.

Figure 11:
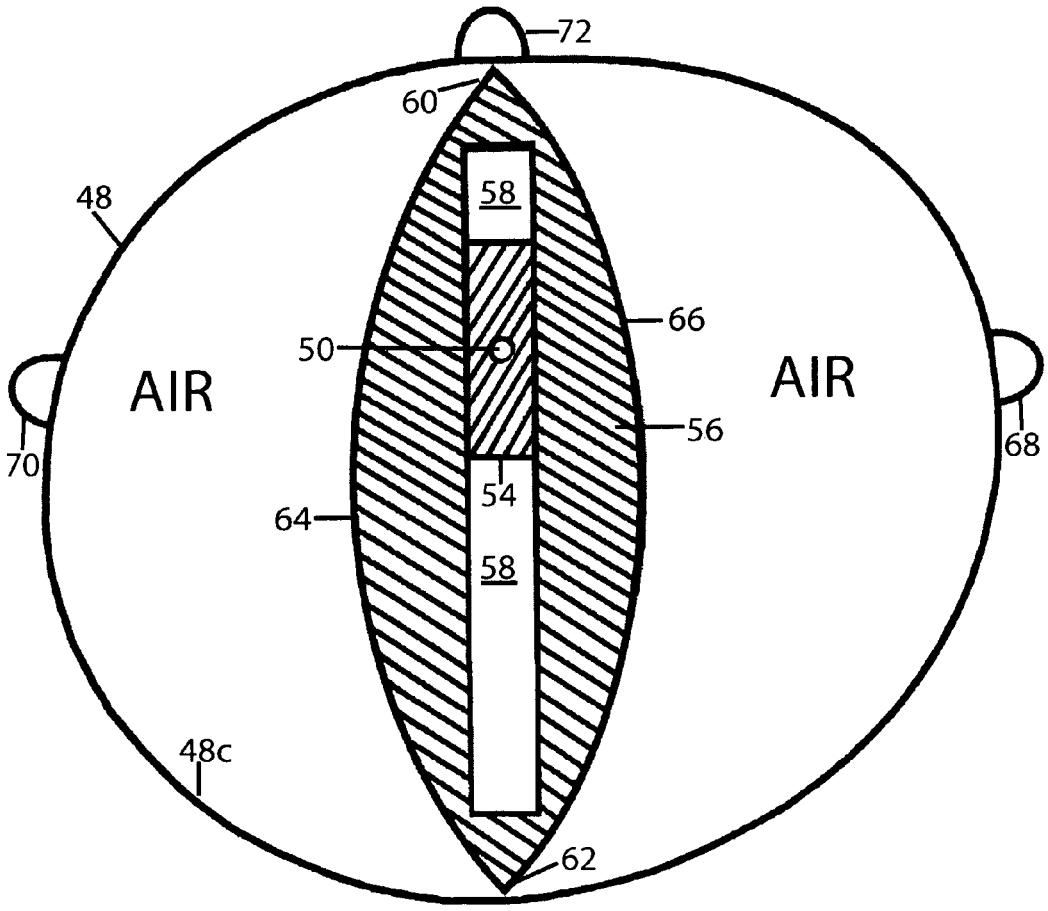

FIG. 11. The rotor 56 is now at a vertical 90° angle with respect to the horizontal starting position and is still turning clockwise with rotor face two 66 receiving air from the air-intake valve 68 while the air on the left-hand side between rotor face one 64 and the chamber 48 wall is being compressed.

Figure 12:
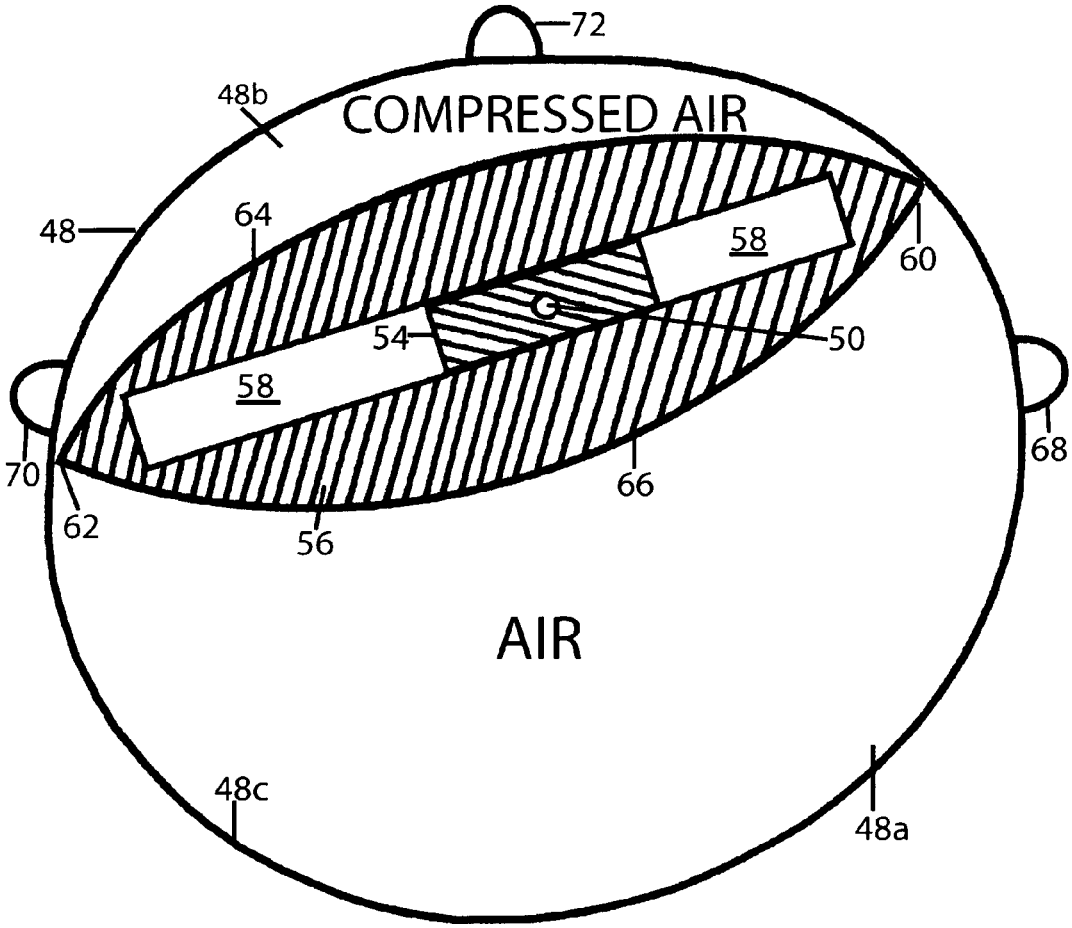

FIG. 12. The rotor 56 is now at a 135° angle with respect to the horizontal starting position and still drawing air from the air-intake valve 68 while on the other side of the rotor 56 air continues to get compressed between rotor face one 64 and the upper left side of the chamber 48 wall.

Figure 13:
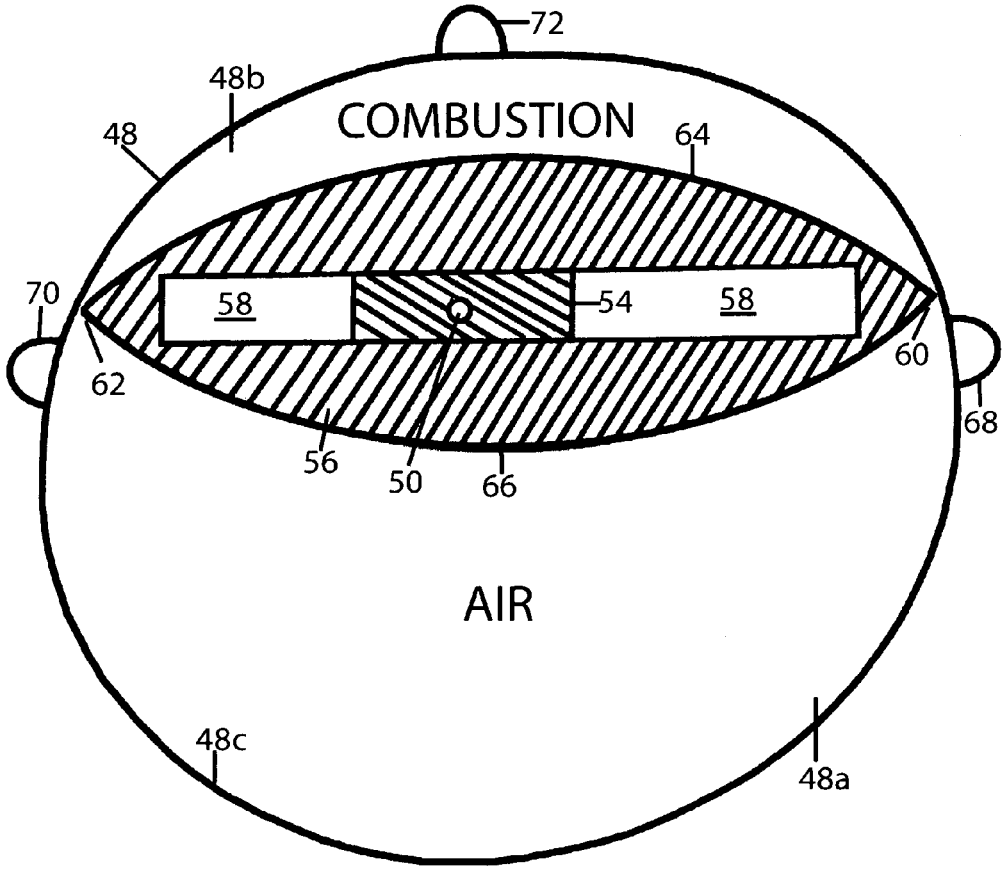

FIG. 13. The rotor 56 is now in a perfect horizontal position and the air trapped in the smaller yousroid sub-chamber space 48*b* between rotor face one 64 and the upper, inner wall of the chamber 48 reaches its maximum pressure and its highest temperature. Fuel enters the smaller yousroid sub-chamber space 48*b* via a fuel supply system 72 and combustion happens. The larger portion and therefore the weightier portion of the rotor 56 lies to the right of generating point 50. Therefore, combustion will push the rotor 56 clockwise. On the other side of the rotor 56 in the larger yousroid sub-chamber space 48*a* the maximum amount of air has been trapped between rotor face two 66 and the lower portion of the chamber 48 wall.

Figure 14:
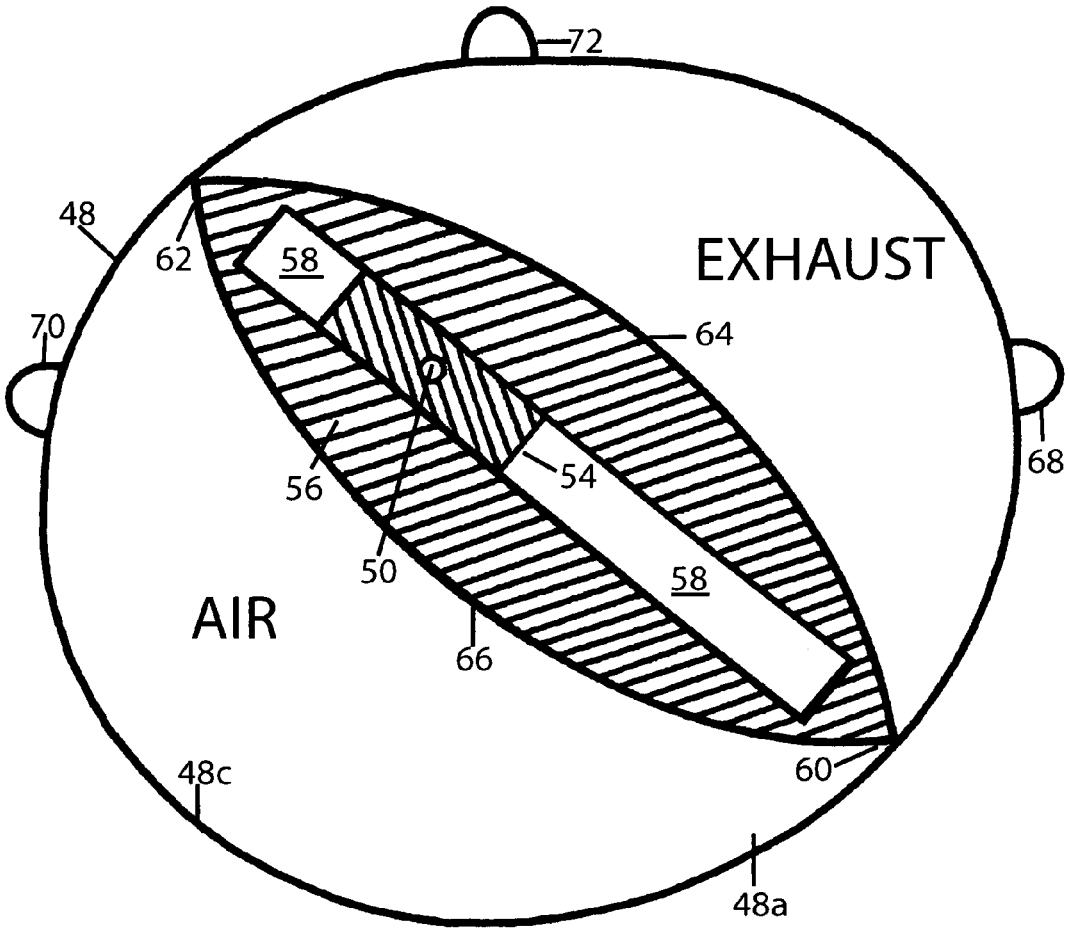

FIG. 14. The mixture of ignited gases causes high pressure on rotor face one 64 pushing the rotor 56 clockwise. The rotor 56 is at a 45° angle relative to the horizontal starting position. The hot expanding gases continue to push the rotor 56 clockwise. On the other side of the rotor 56, rotor face two 66 begins to compress the air against the internal wall of the chamber 48. As the space gets smaller the air temperature begins to rise.

Figure 15:
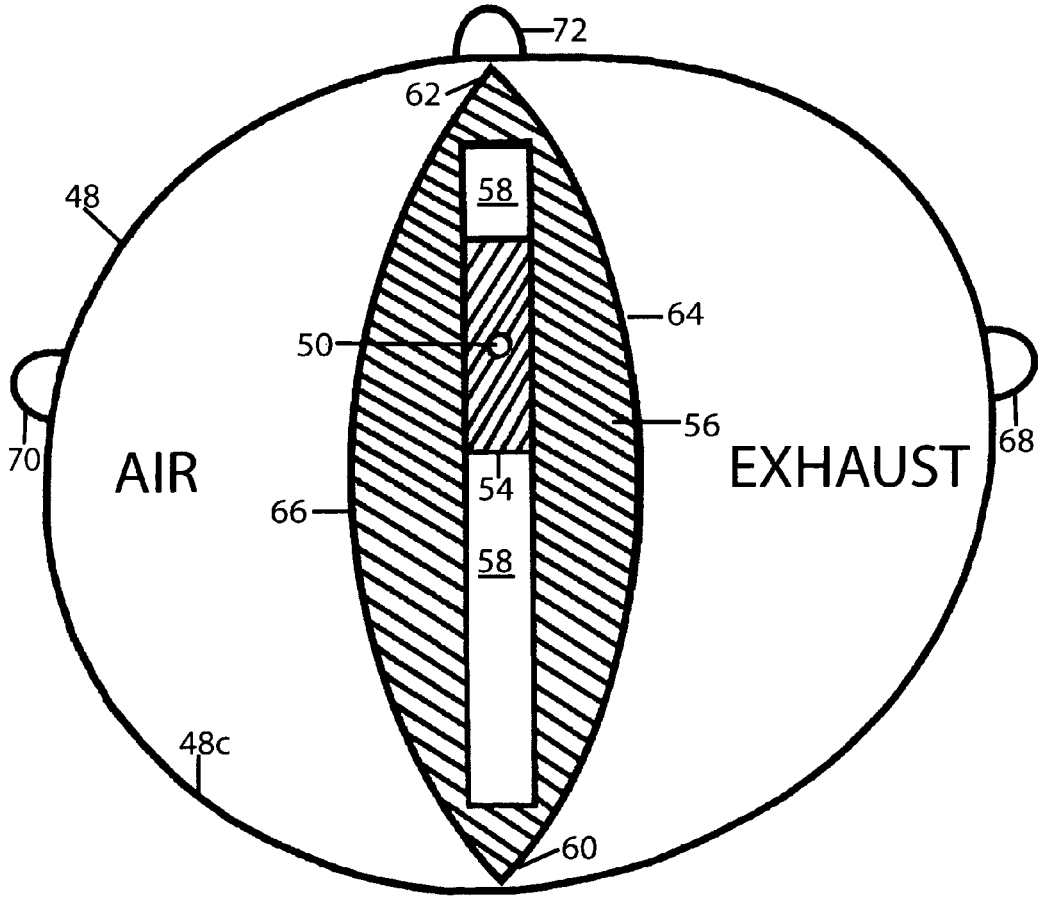

FIG. 15. Rotor 56 is now in a perfect vertical position. The exhaust gases opposite rotor face one 64, are still under high pressure, exerting force on the rotor 56, turning it clockwise. On the other side of the rotor 56, rotor face two 66 is compressing the air against the chamber 48 wall, raising the air's temperature still higher.

Figure 16:
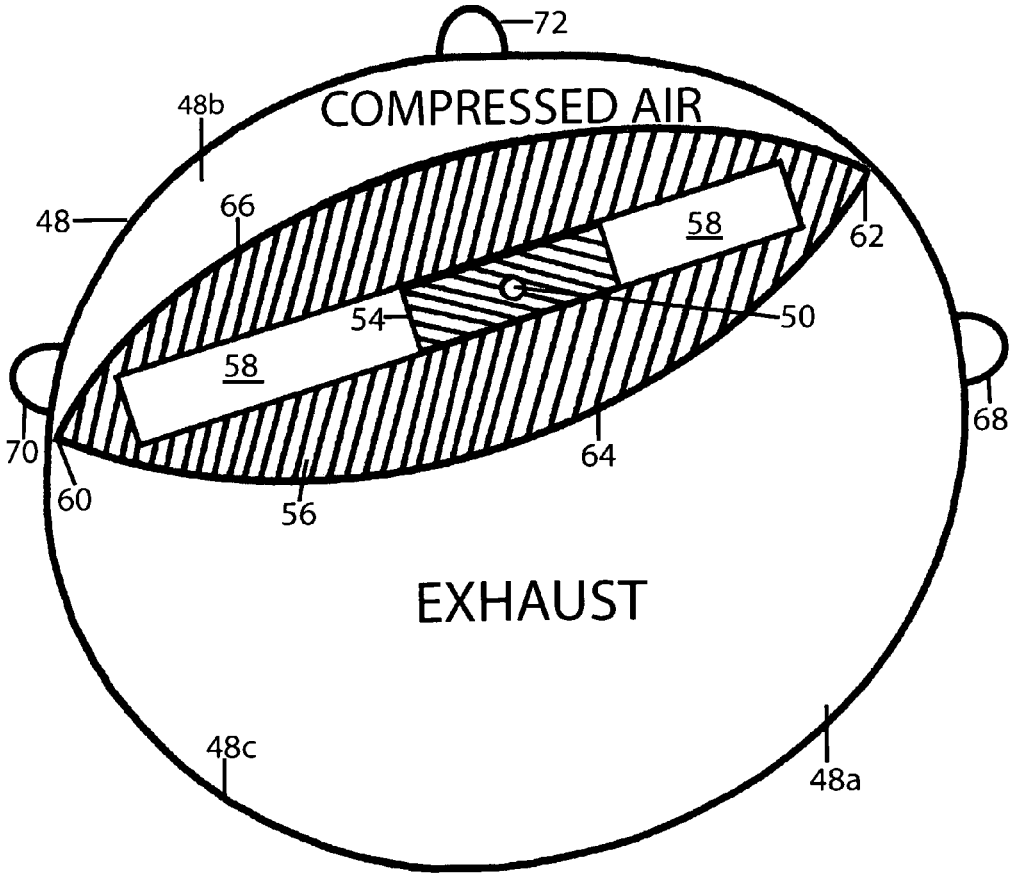

FIG. 16. Now the rotor 56 is at a 135° angle relative to the horizontal starting position. The exhaust opposite rotor face one 64 is expanding and continues to exert a clockwise pressure on the surface of rotor face one 64. The other side of the rotor 56 at rotor face two 66 continues to compress air and raise the temperature.

Figure 17:
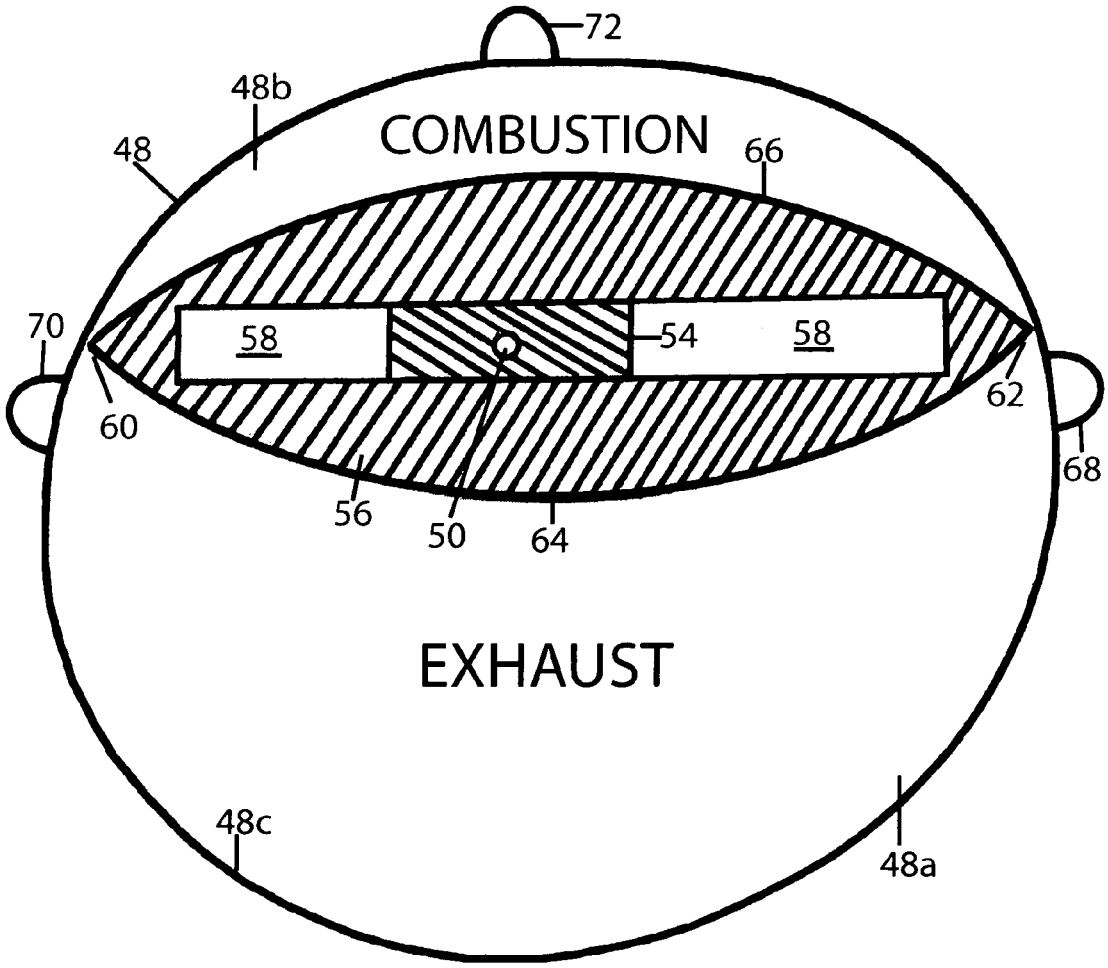

FIG. 17. The rotor 56 is now in a perfect horizontal position and the second mass of fresh air is in the smaller yousroid sub-chamber space 48*b* between rotor face two 66 and the yousroid chamber wall 48*c*, having been compressed to a very high pressure and high temperature. The fuel supply system 72 introduces fuel into the midst of the hot compressed air and combustion takes place. On the other side of rotor 56 at rotor face one 64 the exhaust from the first combustion event (noted in FIG. 12) is accumulated in the larger yousroid sub-chamber space 48*a* and about to be expelled.

Figure 18:
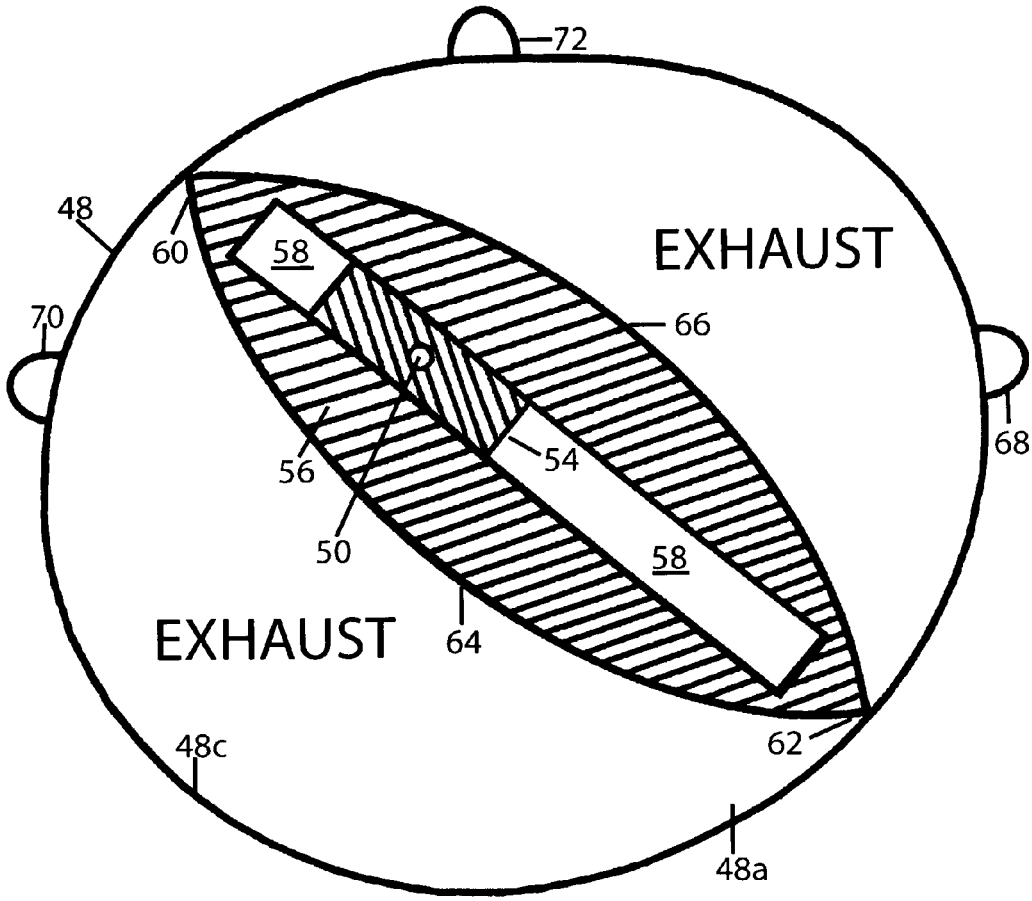

FIG. 18. At this point both sides of rotor 56 contain exhaust. The rotor 56, under the pressure from the combusted gases opposite rotor face two 66 is pressured to turn clockwise and is now at a 45° angle relative to the horizontal starting position. On the other side of the turning rotor 56 the exhaust from the first combustion event (FIG. 12) captured between rotor face one 64, and the chamber 48 wall continues to be expelled through the exhaust valve 70.

Figure 19:
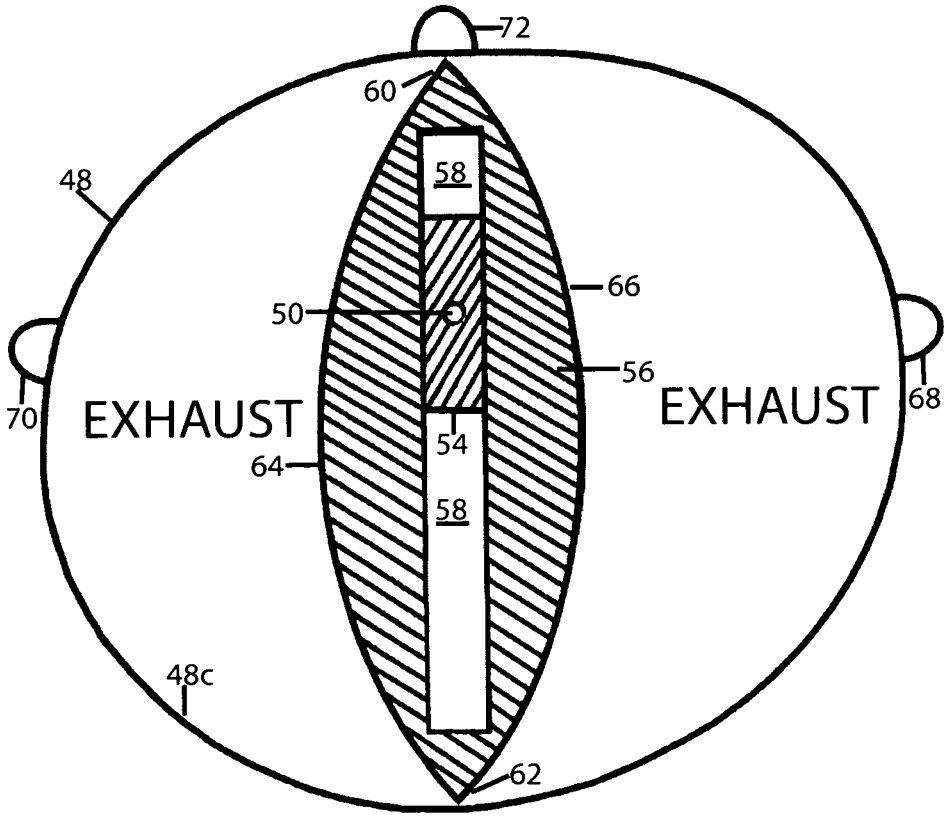

FIG. 19. The Rotor 56 is now in a vertical position. Rotor face two 66, containing the freshly combusted gases still under pressure will push the rotor 56 clockwise. On the other side of the rotor 56 at rotor face one 64 the first mass of exhaust gases (from combustion noted in FIG. 12) is being expelled through the exhaust valve 70.

Figure 20:
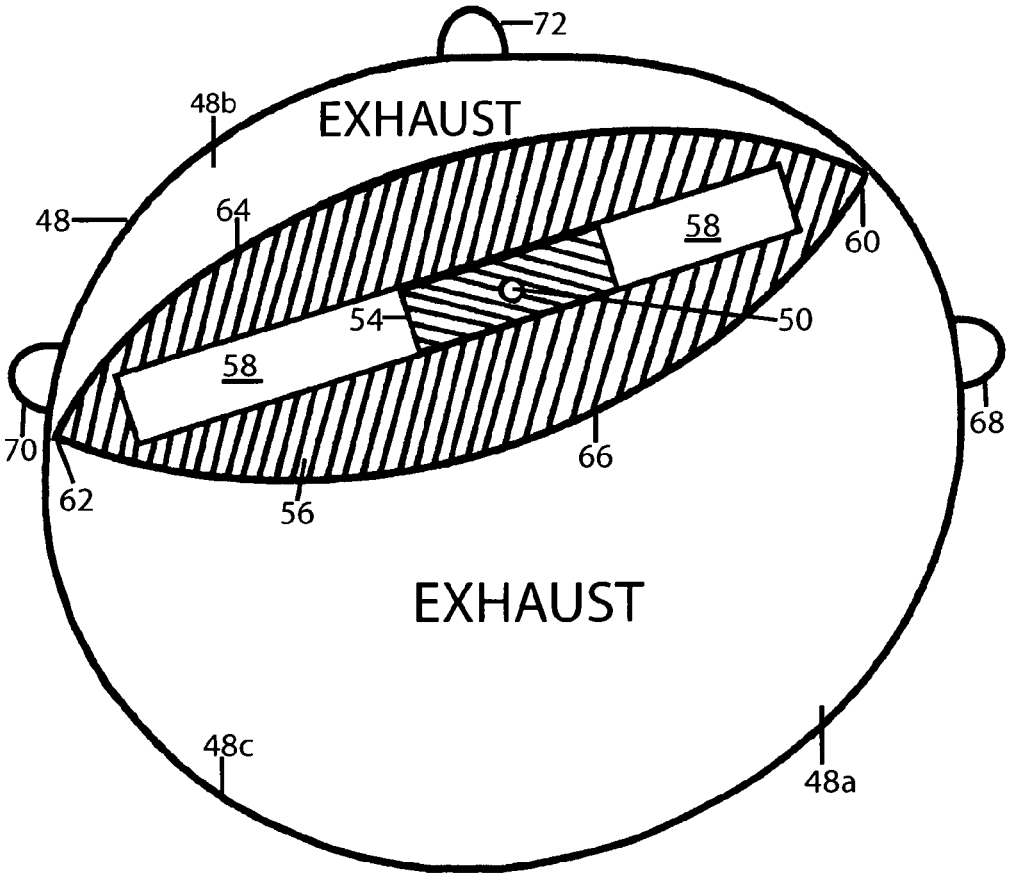

FIG. 20. The rotor 56 is now at a 135° angle with respect to the horizontal starting position and the exhaust gases opposite rotor face two 66 are expanding and exerting pressure on the rotor 56 to turn clockwise. On the other side of the rotor 56 at rotor face one 64 the first mass of exhaust (from the combustion noted in FIG. 12) continues to exit through the exhaust valve 70.

Figure 21:
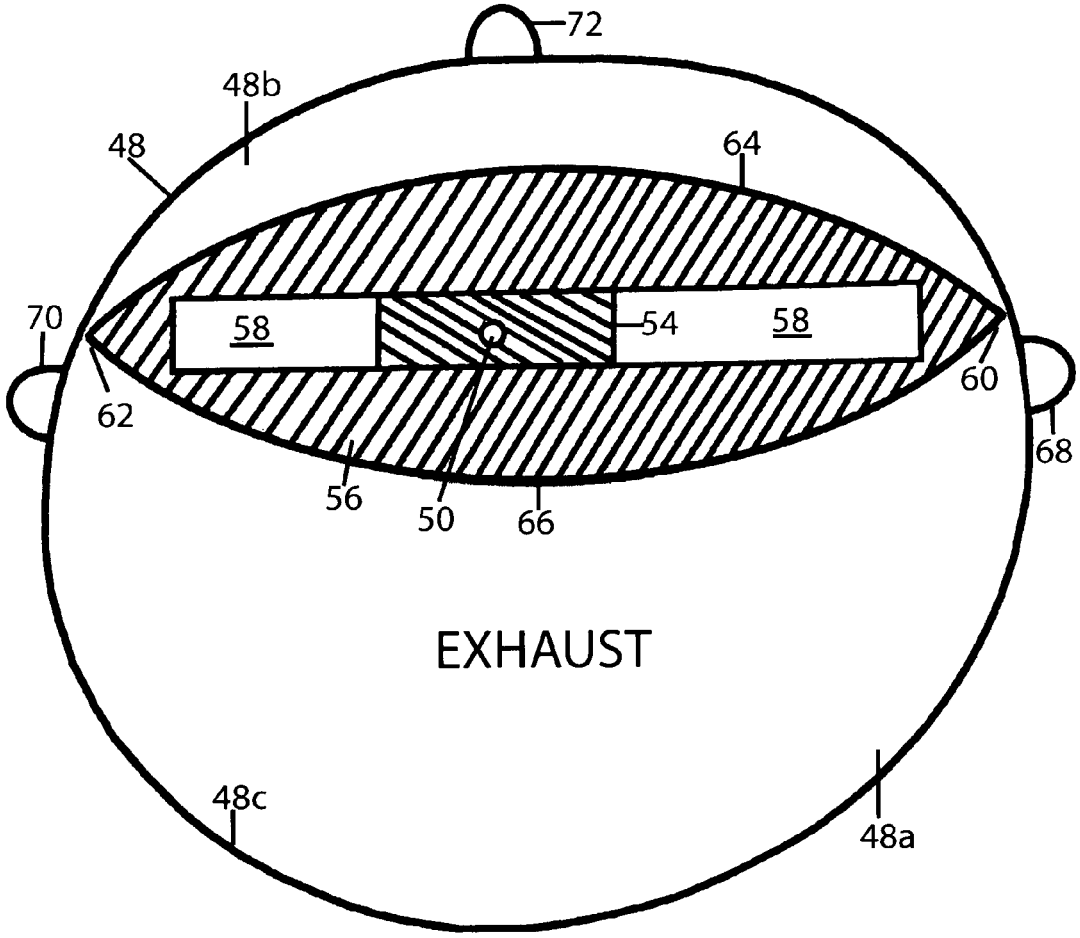

FIG. 21. The rotor 56 is now in a perfectly horizontal position. The smaller yousroid sub-chamber space 48*b* opposite rotor face one 64 is clear of exhaust and about to begin another cycle. The rotor 56 continues to turn either under the pressure exerted by a second rotor (not shown) attached to the same shaft 52, or under the effect of a fly-wheel (not shown) external to the engine, forcing the rotor 56 to rotate clockwise. On the other side in the larger yousroid sub-chamber space 48*a* opposite rotor face two 66 there commences the elimination of the second mass of exhaust (from the combustion noted in FIG. 16) through the exhaust valve 70.

Figure 22:
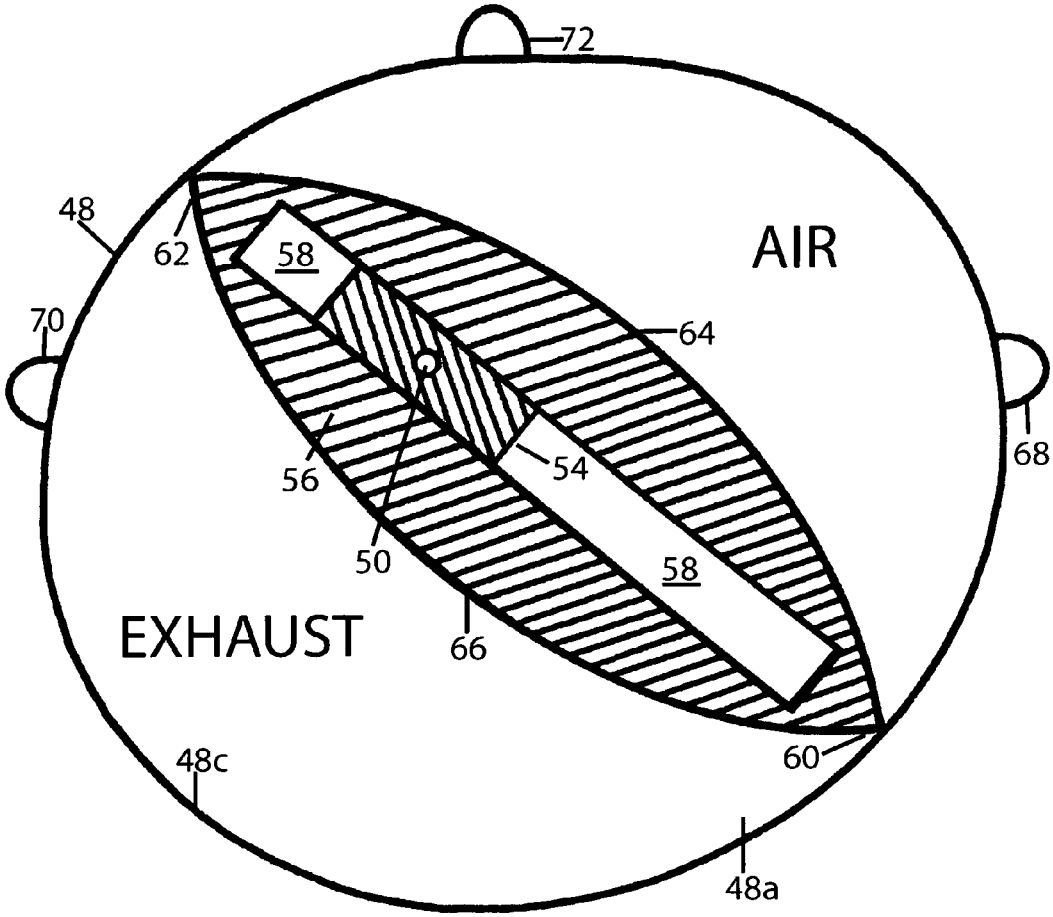

FIG. 22. The first cycle has ended and the second cycle is beginning with the positioning of the rotor 56 at a 45° angle relative to the horizontal starting position. Rotor apex one 60 has passed by the air-intake valve 68 and a new mass of air enters the chamber 48, thereby beginning the second cycle of the engine. On the other side of the rotor 56 at rotor face two 66 the second mass of exhaust is being discharged through the exhaust valve 70. This action marks the end of the first cycle. Subsequent cycles repeat the above-described process.

FIG. 23. Side view of the engine, with a posterior plate 78, a yousroid chamber and rotor housing 46, an intermediate plate 80, a second rotor housing 46, and an anterior plate 82. All of these housing units are bolted together; seals (not shown) are placed between the units to prevent leakage. The cylindrical power-output shaft 52 extends through the posterior plate 78 and connects to the two rotors 56.

FIG. 24. Side view of a power-output shaft 52, with rectangular segment(s) 54 on which a rotor(s) 56 will be mounted.

Description of a Gasoline Engine Embodiment and Operation

All of the characteristics of a diesel embodiment described above under FIGS. 5 through 24 apply to a gasoline engine embodiment, with the addition of FIG. 25:

FIG. 25. Shows the engine 46 modified to operate as a rotary internal combustion gasoline engine by adding an ignition device 76 installed in the yousroid chamber and rotor housing so as to face the smaller yousroid sub-chamber space, such that the ignition device can directly ignite the mixture of fuel and hot compressed air in the smaller yousroid sub-chamber space. Under certain circumstances, an engine can be produced that operates in both diesel and/or gasoline modes.

Description of Additional Embodiments

Figure 27:
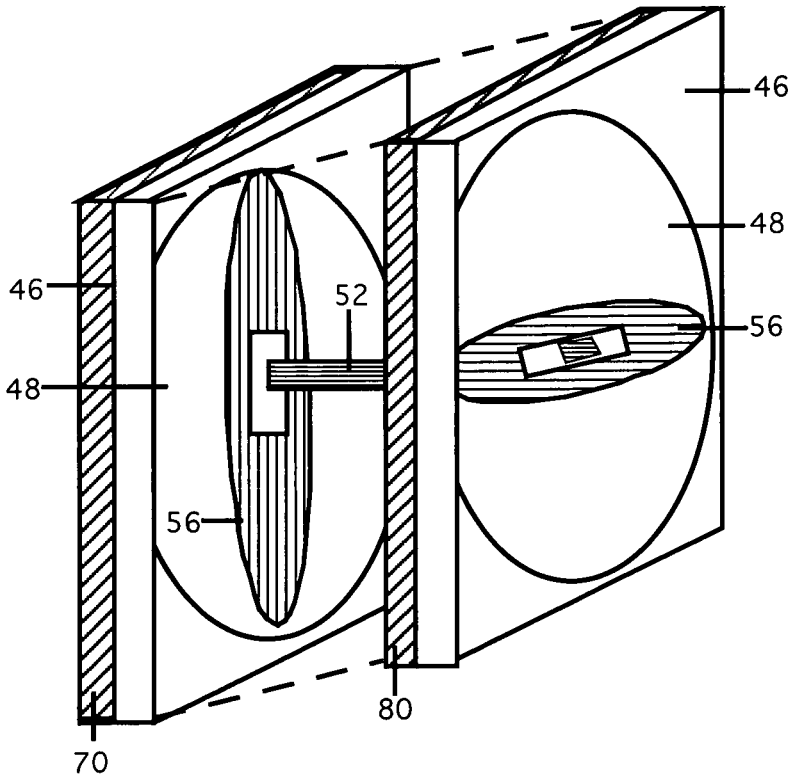
FIG. 27 is a perspective view of two outer-rotor housings 46 coupled together with a power-output shaft 52, wherein one rotor 56 is in a vertical position and the other rotor 56 is in horizontal position.
Figure 28:
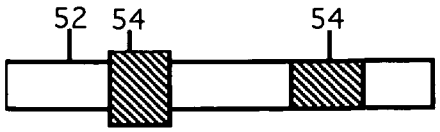
FIG. 28 shows a power-output shaft for a non-combustive pressure motor with one rectangular segment 54 in a vertical position and the other rectangular segment 54 in a horizontal position.

The following commentary, along with FIGS. 26 and 27, is made with respect to pump and non-combustive pressure motor embodiments:

FIG. 26. In order to adapt this invention to function as a pump, an input port 74 must be located just above the right-hand rotor apex 60, and an output port just below the left-hand rotor apex 62 when the rotor 56 is in a horizontal position. The input port draws fluid into the pump's yousroid chamber by suction. The fluid is then compressed and ejected through the output port 70*a* positioned in the same general location as the exhaust port of an internal combustion embodiment. A pump embodiment will require an external electric or combustion engine power source (not shown) attached to the shaft to turn a rotor 56 in a clockwise direction.

FIGS. 26 and 27. In order to adapt this invention to function as a non-combustive pressure motor, an input port 74 must be located just above the right-hand rotor apex 60, when a rotor 56 is in a horizontal position, as shown in FIG. 26. Furthermore, as FIG. 27 shows, there must be a minimum of two rotors 56, each in its own yousroid chamber 48, and each rotor 56 continuously in a 90° orientation in relation to the other rotor 56, both rotors mounted either on the same power-output shaft 52 or on at least two coupled power-output shafts. To accomplish this orientation, a power-output shaft or linked shafts must have at least one rectangular segment 54 in each yousroid chamber: one segment 54 vertical, the other segment 54 horizontal, as shown in FIG. 27. This adaptation is necessary because in a non-combustive pressure motor embodiment, there is a passive phase in each rotor 56 that is overcome by the impetus of the other rotor 56. At this point a second rotor 56 in a separate yousroid chamber 48 connected to the same shaft 52 provides sufficient momentum to tilt the rotor in a clockwise direction. FIG. 27 shows the orientation of two rotors in this embodiment: one horizontal, the other vertical. The rotors are propelled either by gaseous substances or by fluid under high pressure introduced through the input port 74 and then ejected through an output port 70*a*.

It is understood that all drawings cited above are illustrative only, and should not be construed as defining the scope and limits of the invention as to which reference should be made to the section detailing claims and their legal equivalents, rather than by the examples given. Furthermore, the specific examples mentioned above are illustrative of some of the various feasible embodiments of this invention. It is also understood that this invention is capable of mechanical alteration and adaptation without departing from the spirit and scope of the invention.

I claim:

1. A rotary engine comprising:

an outer rotor housing having an internal cavity the peripheral surface of which has a yousroid profile;

an anterior plate, a posterior plate, and, in configurations using at least two outer rotor housings, at least one intermediate partition plate, whereby said anterior plate and said posterior plate, in cooperation with said outer rotor housing's internal cavity, form a yousroid chamber;

a two-apex rotor of a vesica piscis profile mounted for relative rotation within said outer rotor housing with the two working faces of said two-apex rotor extending between the apex portions, each face functioning as a piston, the apex portions of said two-apex rotor having continuous sealing cooperation with an interior surface of said outer rotor housing to define a smaller yousroid sub-chamber and a larger yousroid sub-chamber between said two-apex rotor and said outer rotor housing which vary in volume in response to said relative rotation; and a generating point within said internal cavity through which all straight lines extending from cavity wall to cavity wall in any direction, and also passing through said generating point, are exactly the same length, and wherein said generating point is also located such that when said smaller yousroid chamber is at maximum compression said generating point is not located at the center of said two-apex rotor.

2. The rotary engine according to claim 1, further comprising:

a power-output shaft characterized in that the axis of said power-output shaft is positioned on said generating point, and further characterized in that at least one section of said power-output shaft is rectangular;

a rectangular aperture, positioned approximately lengthwise between said two-apex rotor's faces, said rectangular aperture being of sufficient width to permit said rotor to fit on said rectangular segment of said power-output shaft, and of sufficient length to permit said two-apex rotor to move freely from side to side, and to rotate around said yousroid chamber, causing said power-output shaft to rotate;

at least one air intake channel with an intake valve, wherein air is introduced into the larger yousroid sub-chamber;

at least one exhaust channel with an exhaust valve, wherein combusted gases are removed from the larger yousroid sub-chamber; and at least one fuel supply device capable of introducing fuel into the smaller yousroid sub-chamber, whereby the rotation of said two-apex rotor reduces the volume of the smaller yousroid sub-chamber creating a mixture of compressed, heated air, and fuel resulting in a combustion event, imposing rotational forces on said rotor to impart rotational motion to said power-output shaft.

3. The rotary engine according to claim 2, wherein the at least one fuel supply device is a fuel injector.

4. The rotary engine according to claim 2, further comprising:

at least one ignition means installed in the yousroid chamber and rotor housing so as to face onto and penetrate the smaller yousroid sub-chamber, such that the ignition means can directly ignite a fuel/air mixture in the smaller yousroid sub-chamber.

5. The rotary engine according to claim 4, wherein the at least one fuel supply device is a fuel injector; and the at least one ignition means is an ignition plug.

6. The rotary engine according to claim 1, wherein two or more rotors and two or more outer rotor housings, added in pairs, and at least one intermediate plate, are combined into a single engine block comprised of as many yousroid chambers as there are rotors, all on the same plane and all connected to said power-output shaft or to said power-output shaft comprised of a multiplicity of coupled shafts.

7. The rotary engine according to claim 1, wherein the compression ratio is adjusted by adjusting the location of the generating point on a yousroid pattern-making device prior to drawing a yousroid chamber pattern.

8. The rotary engine according to claim 1, wherein a mirror image of a yousroid pattern is used, said mirror image resulting in said two-apex rotor and said power-output shaft rotating in the reverse direction.

9. The rotary engine according to claim 1, further comprising:

a power-output shaft characterized in that the axis of said power-output shaft is positioned on said generating point, and further characterized in that at least one section of said power-output shaft is rectangular;

a rectangular aperture, positioned approximately lengthwise between said two-apex rotor's faces, said rectangular aperture being of sufficient width to permit said two-apex rotor to fit on said rectangular segment of said power-output shaft, and of sufficient length to permit said two-apex rotor to move freely from side to side, and to rotate around said yousroid chamber, causing said power-output shaft to rotate;

at least one input port positioned just above said rotor when said rotor is in a horizontal position; and at least one output port.

10. The rotary engine according to claim 9, further characterized in that at least two two-apex rotors, each in its own yousroid chamber, are mounted in pairs on the same power-output shaft or on the same power-output shaft consisting of a multiplicity of linked shafts, said power-output shaft having at least two rectangular segments consisting of one horizontal rectangular segment and one vertical rectangular segment, with said rotors mounted on said rectangular segments, said horizontal and vertical rectangular segments causing said rotors to be in a 90° orientation to one another.

11. The rotary engine as recited in claim 1, wherein the compression ratio is adjusted by increasing or decreasing the convexity of said rotor faces.

12. The rotary engine as recited in claim 1, wherein the compression ratio is adjusted by altering the location of the generating point on a yousroid pattern-making device prior to drawing a yousroid chamber pattern, and by increasing or decreasing the convexity of said rotor faces.

* * * * *